US011982068B2

(12) United States Patent
Horii

(10) Patent No.: US 11,982,068 B2
(45) Date of Patent: May 14, 2024

(54) WORKING MACHINE

(71) Applicant: KUBOTA CORPORATION, Osaka (JP)

(72) Inventor: Hiroshi Horii, Sakai (JP)

(73) Assignee: KUBOTA CORPORATION, Osaka (JP)

( * ) Notice: Subject to any disclaimer, the term of this patent is extended or adjusted under 35 U.S.C. 154(b) by 273 days.

(21) Appl. No.: 16/896,581

(22) Filed: Jun. 9, 2020

(65) Prior Publication Data

US 2020/0299928 A1 Sep. 24, 2020

Related U.S. Application Data

(63) Continuation of application No. PCT/JP2018/039319, filed on Oct. 23, 2018.

(30) Foreign Application Priority Data

Dec. 22, 2017 (JP) ..... 2017-246320

(51) Int. Cl.
*E02F 3/32* (2006.01)
*E02F 9/12* (2006.01)

(52) U.S. Cl.
CPC ..... *E02F 9/121* (2013.01); *E02F 9/125* (2013.01); *E02F 9/126* (2013.01); *E02F 3/325* (2013.01)

(58) Field of Classification Search
CPC .. B66C 23/84; E02F 9/126; E02F 9/12; E02F 9/123; E02F 9/20; E02F 9/202; E02F 9/2095; E02F 9/125; E02F 9/0858; E02F 9/24; E02F 3/32; F16J 15/32; B60L 2200/40; F16H 1/04; B60Y 2200/412
See application file for complete search history.

(56) References Cited

U.S. PATENT DOCUMENTS 1,272,110 A * 7/1918 Robinson ..... E02F 9/062 212/302
2,313,084 A * 3/1943 Manly ..... B66C 23/84 104/46
2,472,726 A * 6/1949 Russell ..... E02F 9/121 414/689

(Continued)

FOREIGN PATENT DOCUMENTS

CN 103423538 A 12/2013
CN 105283374 A 1/2016

(Continued)

*Primary Examiner* — Edwin J Toledo-Duran
(74) *Attorney, Agent, or Firm* — Birch, Stewart, Kolasch & Birch, LLP

(57) ABSTRACT

A working machine includes a traveling device having a traveling frame, a turn base plate supported on the traveling frame and configured to turn around an axis extending in a vertical direction, the turn base plate having an opening portion through which the axis extends, and a swivel joint including an outer sleeve fixed to the turn base plate, and an inner shaft inserted to the opening portion and inserted to the outer sleeve so as to rotate about the axis, the inner shaft being configured to restrictively rotate with respect to the traveling frame. The outer sleeve has a flange portion fixed to the turn base plate on a periphery of the opening portion and covering the opening portion.

11 Claims, 17 Drawing Sheets

(56) References Cited

U.S. PATENT DOCUMENTS 2,838,183 A * 6/1958 McIntyre, Sr. ..... B66C 23/84 212/247
2,928,381 A * 3/1960 Macdonald ..... E02F 3/764 91/186
3,184,867 A * 5/1965 Symmank ..... E02F 9/028 180/9.54
3,369,672 A * 2/1968 Lorence ..... B62D 55/062 475/83
3,873,133 A * 3/1975 Berg ..... F16L 39/04 285/190
4,102,461 A * 7/1978 Soyland ..... B60K 5/00 212/253
4,277,899 A * 7/1981 Guthoff ..... E02F 9/26 37/413
4,906,113 A * 3/1990 Sague ..... F16C 33/3706 384/618
4,943,182 A * 7/1990 Hoblingre ..... F16D 1/108 403/328
5,071,310 A * 12/1991 Weyer ..... E02F 3/303 414/727
5,074,370 A * 12/1991 Lindstrot ..... E02F 9/24 180/41
5,151,068 A * 9/1992 Mann ..... F16H 3/54 192/85.37
5,528,140 A * 6/1996 Fuki ..... F02P 7/0675 123/612
6,164,829 A * 12/2000 Wenzel ..... F16C 11/0638 403/135
10,968,605 B2 * 4/2021 Kawamura ..... E02F 9/006
11,169,045 B2 * 11/2021 Ramamurthy ..... G06T 7/215
2002/0020685 A1 * 2/2002 Weckbecker ..... F16C 19/50 212/181
2003/0085562 A1 * 5/2003 Sparling ..... B60G 5/00 280/789
2004/0244521 A1 * 12/2004 Russ ..... B66C 23/84 74/425
2005/0046181 A1 * 3/2005 Falconer ..... F16L 39/06 285/121.6
2005/0253339 A1 * 11/2005 Hoshi ..... B66C 23/84 277/549
2007/0152438 A1 * 7/2007 Lacher ..... B62D 21/186 280/781
2007/0266601 A1 * 11/2007 Claxton ..... G01L 5/101 37/396
2008/0086920 A1 * 4/2008 Lim ..... E02F 3/404 37/406
2010/0226710 A1 * 9/2010 Yamasaki ..... E02F 3/382 403/81
2010/0265806 A1 * 10/2010 Matsushima ..... G01D 15/00 369/53.41
2013/0089400 A1 * 4/2013 Uzawa ..... E02F 9/126 414/744.1
2013/0177377 A1 * 7/2013 Van Hooft ..... E02F 3/3654 414/723
2013/0197766 A1 * 8/2013 Kurikuma ..... E02F 9/2246 701/50
2014/0145429 A1 * 5/2014 Chung ..... F16L 27/02 285/144.1
2014/0294486 A1 * 10/2014 Staade ..... B62D 7/16 403/113
2015/0155759 A1 * 6/2015 Matsuo ..... H02K 11/33 310/52
2015/0226288 A1 * 8/2015 Shizu ..... E02F 9/12 475/333
2016/0010309 A1 * 1/2016 Bienfang ..... B23P 15/14 29/893.2
2016/0010694 A1 * 1/2016 Bienfang ..... F16C 33/581 384/593
2017/0045171 A1 * 2/2017 Chioccola ..... F16L 39/04
2017/0096193 A1 * 4/2017 Eide ..... F16L 17/035
2017/0306587 A1 * 10/2017 Hosaka ..... E02F 9/264
2018/0038064 A1 * 2/2018 Jung ..... E02F 3/3681
2018/0170737 A1 * 6/2018 Andersen ..... B67C 3/22
2018/0282975 A1 * 10/2018 Kawamura ..... F16L 27/0804
2019/0178114 A1 * 6/2019 Iwaya ..... F01L 1/356
2020/0153368 A1 * 5/2020 Kobayashi ..... F04C 29/047
2022/0136208 A1 * 5/2022 Okada ..... E02F 9/2275 285/93

FOREIGN PATENT DOCUMENTS

JP 58-129959 U 9/1983
JP 59-98950 U 7/1984
JP 63-38293 Y2 10/1988
JP 5-32379 U 4/1993
JP 6-180019 A 6/1994
JP 6-56166 U 8/1994
JP 7-138995 A 5/1995
JP 9-328778 A 12/1997
JP 10-30775 A 2/1998
JP 2015-161073 A 9/2015
JP 2017-82494 A 5/2017

* cited by examiner

WORKING MACHINE

CROSS-REFERENCE TO RELATED APPLICATIONS

The present application is a continuation application of International Application No. PCT/JP 2018/039319, filed Oct. 23, 2018, which claims priority to Japanese Patent Application No. 2017/246320, filed Dec. 22, 2017. The contents of these applications are incorporated herein by reference in their entirety.

BACKGROUND OF THE INVENTION

Field of the Invention

The present invention relates to a working machine such as a backhoe.

Description of Related Art

The working machine disclosed in Japanese Unexamined Utility Model Publication No. S63-38293 is previously known.

The working machine disclosed in Japanese Unexamined Utility Model Publication No. S63-38293 includes a vehicle body provided with a traveling device, a turn base rotatably provided on the vehicle body, and a swivel joint (a rotary joint) having an inner cylinder connected to the vehicle body and an outer cylinder connected to the turn base.

SUMMARY OF THE INVENTION

A working machine according to one aspect of the present invention, includes: a traveling device having a traveling frame; a turn base plate supported on the traveling frame and configured to turn around an axis extending in a vertical direction, the turn base plate having an opening portion through which the axis extends; and a swivel joint including: an outer sleeve fixed to the turn base plate; and an inner shaft inserted to the opening portion and inserted to the outer sleeve so as to rotate about the axis, the inner shaft being configured to restrictively rotate with respect to the traveling frame. The outer sleeve has a flange portion fixed to the turn base plate on a periphery of the opening portion and covering the opening portion.

DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF THE EMBODIMENTS

Figure 1:
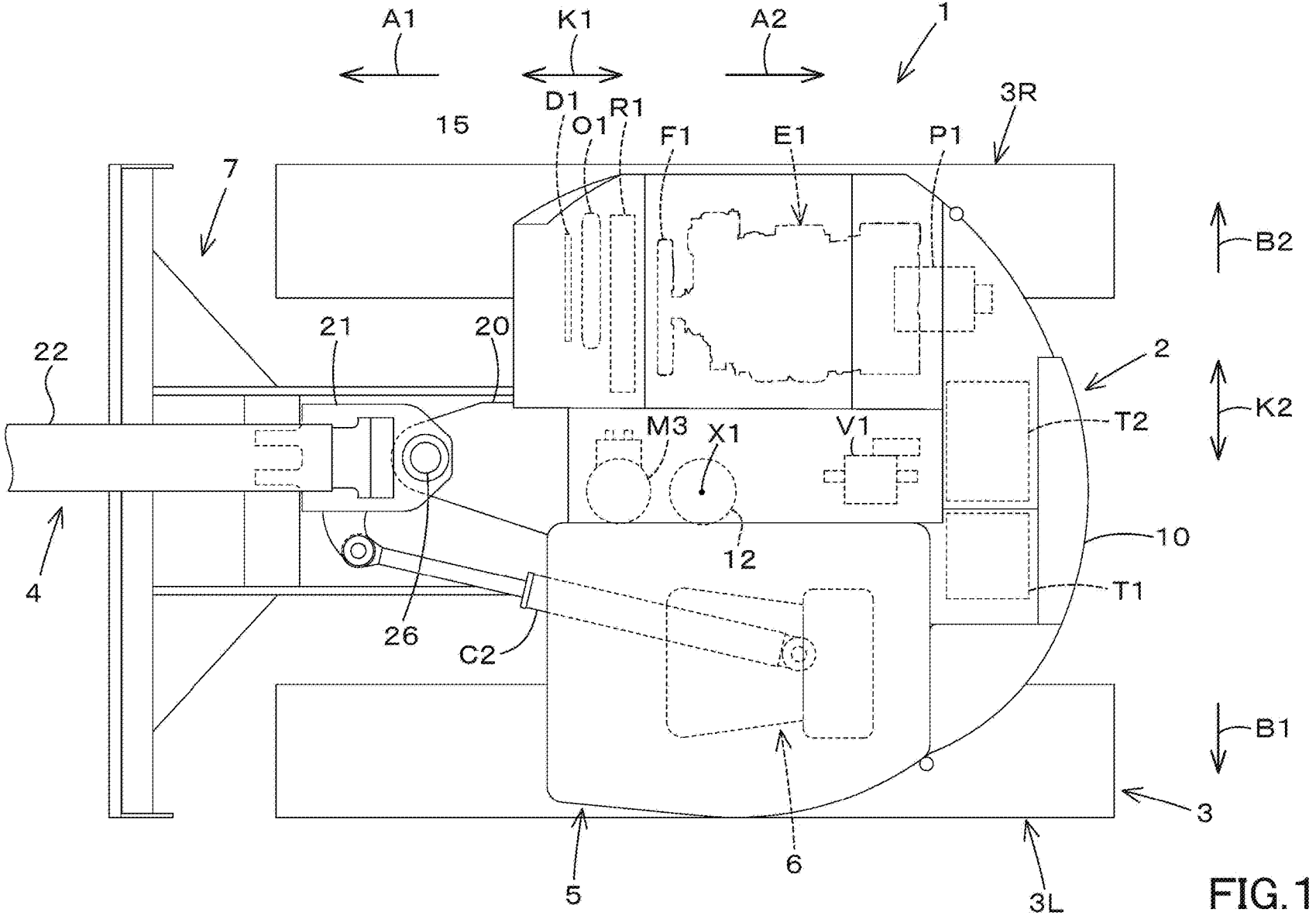
FIG. 1 is a plan view of a working machine according to an embodiment of the present invention.

The embodiments will now be described with reference to the accompanying drawings, wherein like reference numerals designate corresponding or identical elements throughout the various drawings. The drawings are to be viewed in an orientation in which the reference numerals are viewed correctly.

Hereinafter, an embodiment of the present invention will be described with appropriate reference to the drawings.

Figure 2:
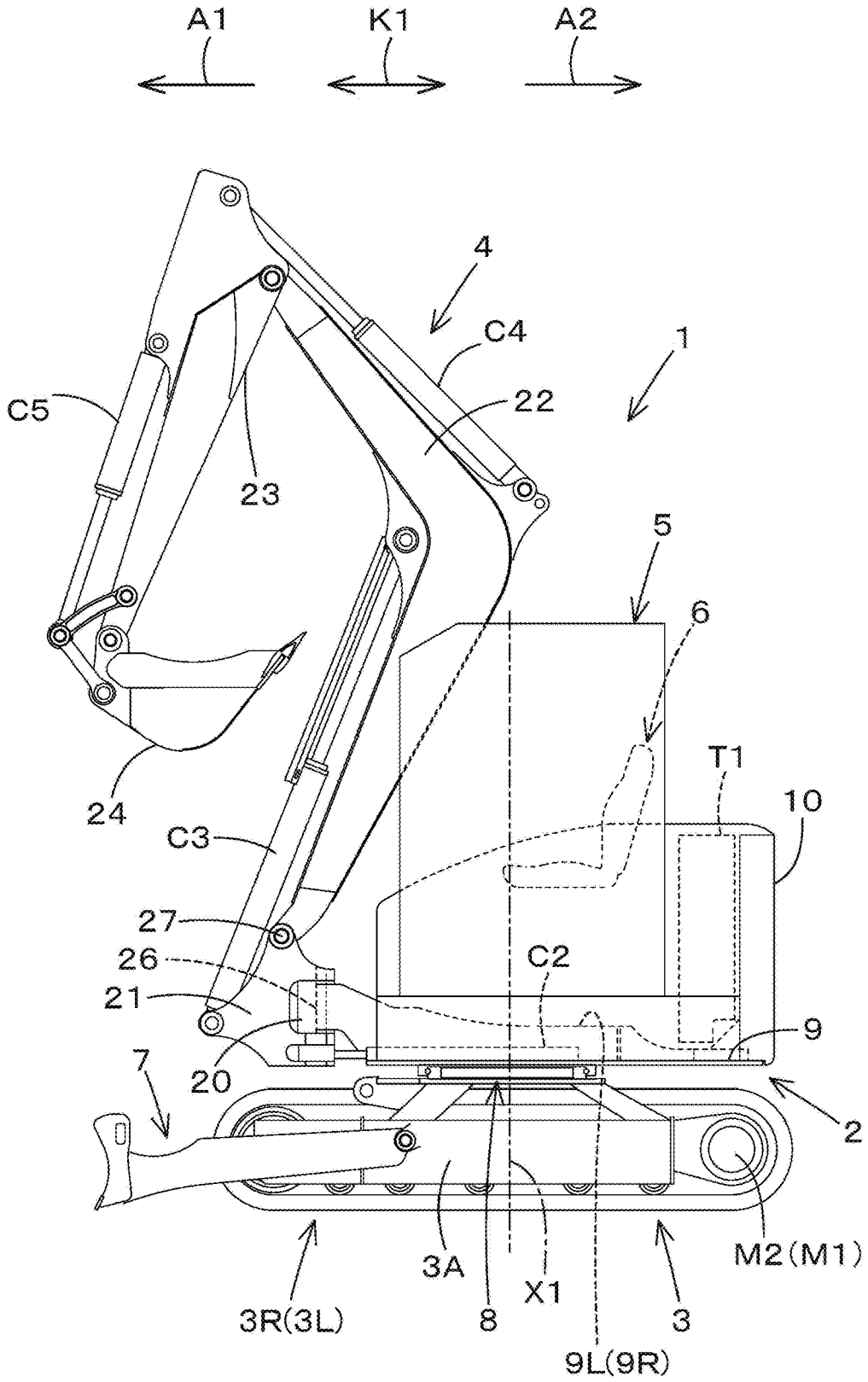
FIG. 2 is a side view of the working machine according to the embodiment.

FIG. 1 is a schematic plan view showing the overall configuration of a working machine 1 according to the embodiment. FIG. 2 is a schematic side view of the working machine 1. In the embodiment, a backhoe, which is a swivel working machine, is exemplified as the working machine 1.

First, the overall configuration of the working machine 1 will be described below.

As shown in FIG. 1 and FIG. 2, the working machine 1 includes a machine body (a turn base) 2, a traveling device 3, and a working device 4. A cabin 5 is mounted on the machine body 2. A operator seat (a seat) 6 on which a driver (an operator) sits is provided inside the cabin 5.

In the present embodiment, the front side of the operator sitting on the operator seat 6 (a direction indicated by an arrowed line A1 in FIG. 1 and FIG. 2) is referred to as the front, the rear side of the operator (a direction indicated by an arrowed line A2 in FIG. 1 and FIG. 2) is referred to as the rear, the left side of the operator (a direction indicated by an arrowed line B1 in FIG. 1) is referred to as the left, and the right side of the operator (a direction indicated by an arrowed line B2 in FIG. 1) is referred to as the right. Additionally in the explanation, the horizontal direction, which is a direction orthogonal to the front-rear direction K1, will be described as the machine width direction K2 (a width direction of the machine body 2) (see FIG. 1 and FIG. 2).

The traveling device 3 is a device for supporting the machine body 2 and is configured to perform the traveling. As shown in FIG. 1 and FIG. 2, the traveling device 3 includes a traveling frame 3A, a first traveling device 3L provided on the left side of the traveling frame 3A, and a second traveling device 3R provided on the right side of the traveling frame 3A. The first traveling device 3L and the second traveling device 3R are crawler type traveling devices. The first traveling device 3L is configured to be driven by the first traveling motor M1. The second traveling device 3R is configured to be driven by the second traveling motor M2. The first traveling motor M1 and the second traveling motor M2 are constituted of hydraulic motors (hydraulic actuators (hydraulic devices)).

A dozer device 7 is attached to the front portion of the traveling device 3. The dozer device 7 is capable of being moved up and down (the blade can be lifted and lowered) when the dozer cylinder (the hydraulic actuator (the hydraulic device)) is stretched and shortened. In addition, the dozer device 7 is capable of being swung about the vertical axis (swung between the left end portion and the right end portion of the blade) when the angle cylinder (the hydraulic actuator (the hydraulic device)) is stretched and shortened.

As shown in FIG. 2, the machine body 2 is supported on the traveling frame 3A with a turn bearing 8 so as to be turned around a turn axis X1. The turn axis X1 is an axial center extending in the vertical direction passing through the center of the turn bearing 8.

Figure 3:
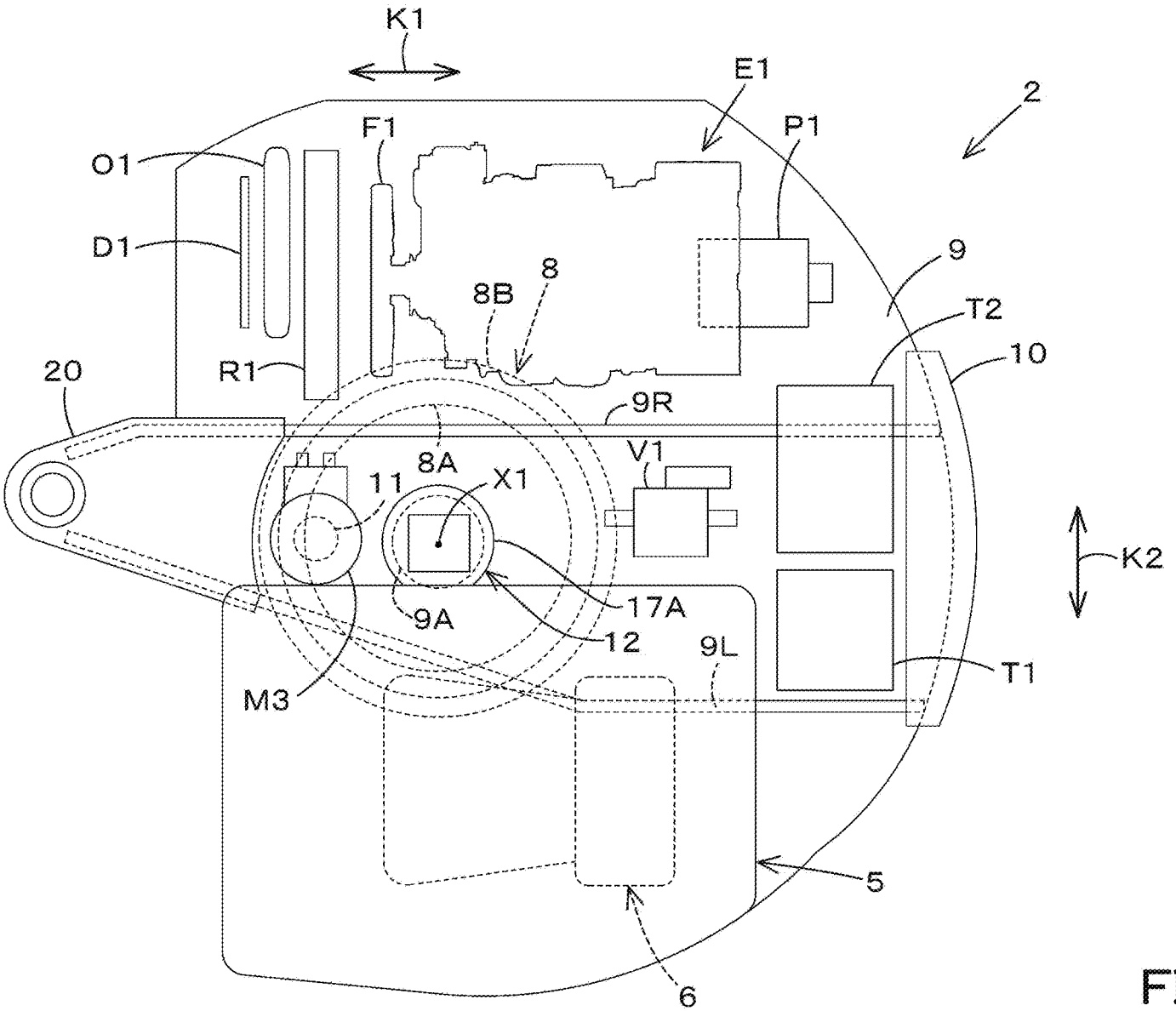
FIG. 3 is a plan view illustrating arrangement of components mounted on the working machine according to the embodiment.

As shown in FIG. 1 and FIG. 3, the cabin 5 is mounted on one side (the left side portion) of the machine body 2 in the width direction K2. A prime mover E1 is mounted on the other side (the right side portion) of the machine body 2 in the width direction K2. The prime mover E1 is a diesel engine. The prime mover E1 may be a gasoline engine, an LPG engine or an electric motor, or may be a hybrid type having an engine and an electric motor.

A hydraulic pump P1 is provided at the rear portion of the prime mover E1. The hydraulic pump P1 is configured to be driven by the prime mover E1 and to pressurize and output the operation fluid to be used in the hydraulic driving portion. The hydraulic driving portion is, for example, a hydraulic actuator equipped in the working machine 1. In front of the prime mover E1, a radiator R1, an oil cooler O1 and a condenser D1 are arranged and mounted on the machine body 2.

The radiator R1 is a cooling device configured to cool the coolant water of the prime mover E1, and the oil cooler O1 is a cooling device configured to cool the operation fluid. The condenser D1 is a cooling device (condenser) configured to cool the refrigerant of the air conditioner device (an air conditioner) installed in the working machine 1. A cooling fan F1 is provided between the radiator R1 and the prime mover E1 to generate the cooling air for cooling the prime mover E1.

As shown in FIG. 2 and FIG. 3, the machine body 2 includes a base plate 9 (hereinafter, referred to as a turn base plate) that turns around the turn axis X1. The turn base plate 9 is made of a steel plate or the like, and constitutes the bottom of the machine body 2. As shown in FIG. 3, vertical ribs 9L and 9R, which are reinforcing members, are provided on the center side of the upper surface of the turn base plate 9, extending from the front to the rear. The vertical rib 9L is arranged closer to one side from the center of the machine body 2 in the width direction K2, and the vertical rib 9R is arranged closer to the other side in the width direction K2. In addition, the turn base plate 9 is provided with the support members and the like for supporting the vertical ribs 9L and 9R, as well as a mounted object such as a device mounted on the machine body 2, thereby forming a turn frame serving as a skeleton of the machine body 2.

As shown in FIG. 1 to FIG. 3, a weight 10 is provided at the rear portion of the machine body 2. The weight 10 is arranged in the rear portion of the machine body 2, and the lower portion is attached to the turn base plate 9. At the rear portion of the machine body 2, a fuel tank T1 and an operation fluid tank T2 which are arranged side by side in the machine width direction K2 are mounted. The fuel tank T1 is a tank configured to store the fuel of the prime mover E1. The operation fluid tank T2 is a tank configured to store the operation fluid.

Figure 5:
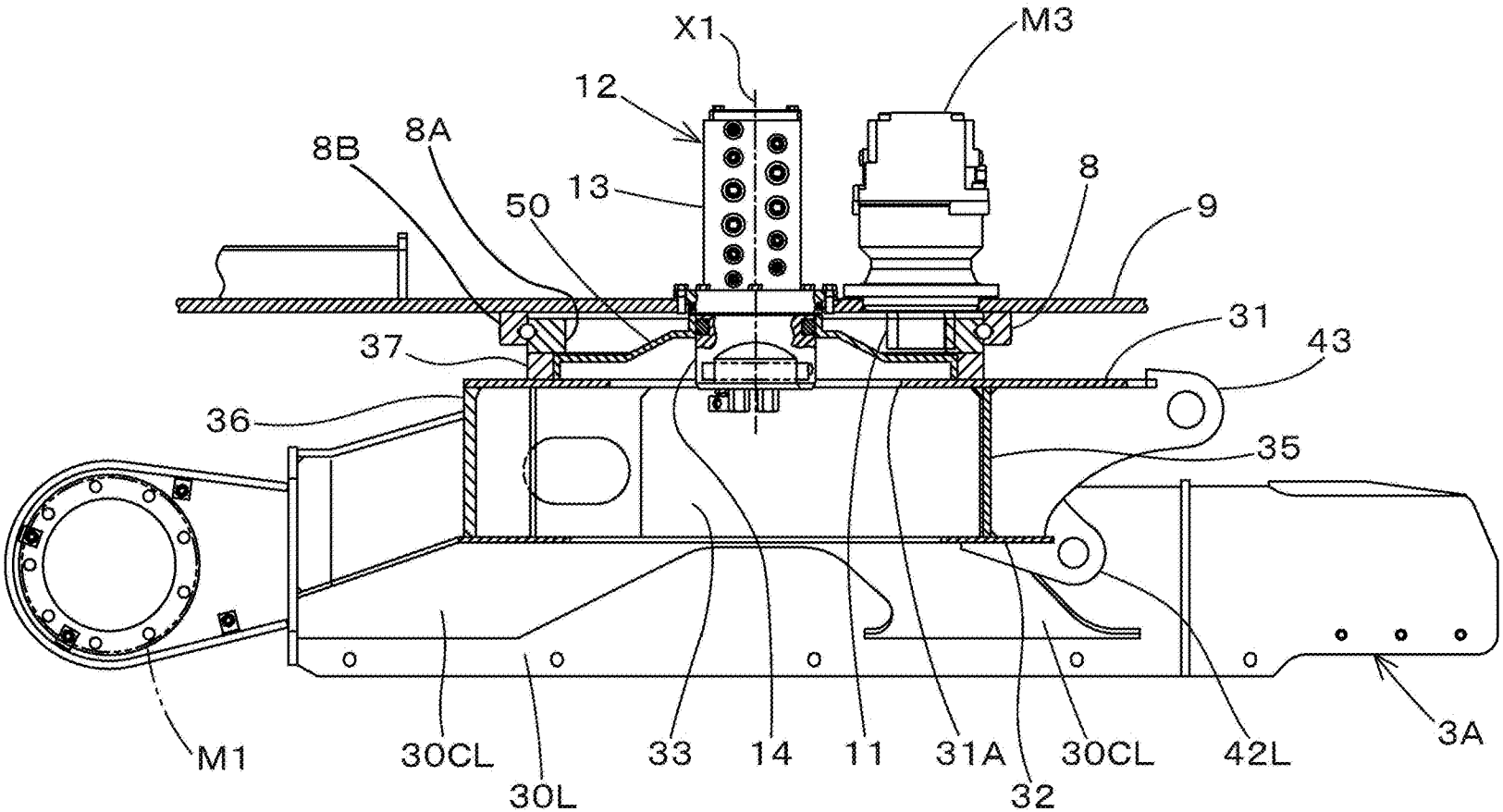
FIG. 5 is a cross-sectional side view illustrating arrangement of the traveling frame, a turn base plate, a swivel joint, the turn motor, and the like according to the embodiment.

As shown in FIG. 3 and FIG. 5, the turn base plate 9 is connected to the upper portion of the turn bearing 8, and the machine body 2 is driven to be turned by the turn motor M3. The turn motor M3 is a hydraulic motor (a hydraulic actuator (a hydraulic device)).

Figure 6:
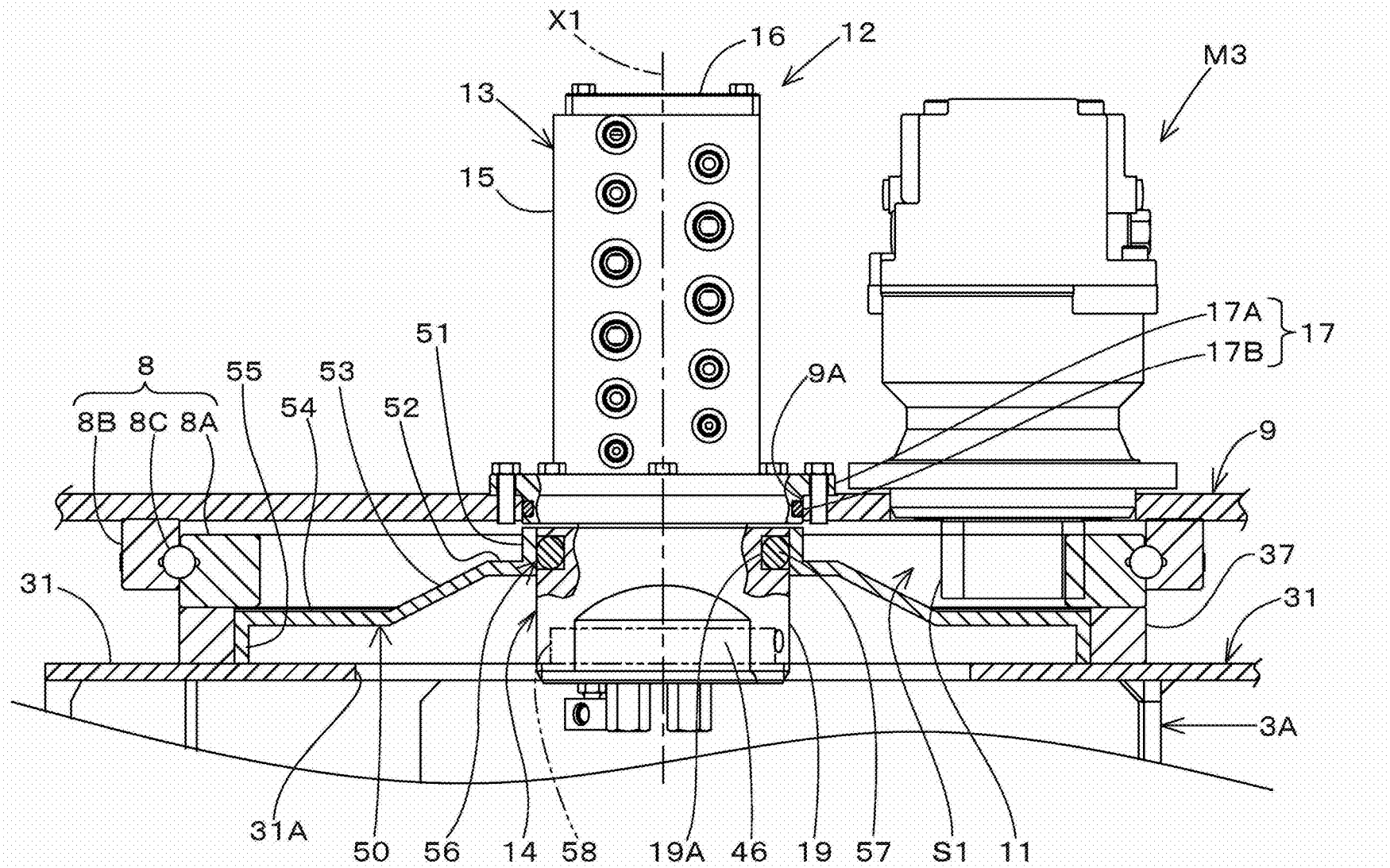
FIG. 6 is a partially-enlarged view of FIG. 5 according to the embodiment.

As shown in FIG. 3 and FIG. 6, the turn bearing 8 includes the inner race 8A fixed to the traveling frame 3A, the outer race 8B fixed to the turn base plate 9, and the ball 8C arranged between the inner race 8A and the outer race 8B. Inner teeth are formed on the inner circumferential portion of the inner race 8A, and the pinions 11 are engaged with the inner teeth. The pinions 11 are attached to the output shaft of the turn motor M3, and the turn motor M3 is fixed to the turn base plate 9. Thus, by driving the pinions 11 by the turn motor M3, the machine body 2 is turned. The center of the turn bearing 8 is the turning center (a turn axis X1) of the machine body 2.

As shown in FIG. 1, FIG. 3, and FIG. 5, the swivel joint 12 is provided at the position of the turn axis X1. The swivel joint 12 is a hydraulic device configured to circulates the operation fluid, and is a turn coupler (a rotary joint) configured to circulate the operation fluid between the hydraulic device arranged on the machine body 2 side and the hydraulic device provided on the traveling device 3 side.

A turn motor M3 is arranged in front of the swivel joint 12. A control valve (a hydraulic device) V1 is arranged behind the swivel joint 12. The control valve V1 is a hydraulic device in which control valves for controlling hydraulic actuators such as a hydraulic cylinder and a hydraulic motor mounted on the working machine 1 are integrated. The control valves constituting the control valve V1 controls a first traveling motor M1, a second traveling motor M2, a turn motor M3, a dozer cylinder C1 (see FIG. 4), a swing cylinder C2, a boom cylinder C3, an arm cylinder C4, a bucket cylinder C5, for example.

As shown in FIG. 3, the machine body 2 arranges a support bracket 20 slightly to the right in the front portion from the center in the machine width direction K2. The support bracket 20 is fixed to the front portions of the vertical ribs 9L and 9R, and is provided so as to project forward from the machine body 2.

As shown in FIG. 1 and FIG. 2, the swing bracket 21 is attached to a front portion (a portion protruding from the machine body 2) of the support bracket 20 with the swing shaft 26 so as to be swingable about the vertical axis. Thus, the swing bracket 21 is configured to be turned in the machine width direction K2 (turned horizontally around the swing shaft 26).

The working device 4 is attached to the swing bracket 21.

As shown in FIG. 2, the working device 4 has a boom 22, an arm 23, and a bucket (a working tool) 24. A base portion 22A of the boom 22 is pivotally attached to an upper portion of the swing bracket 21 with a boom pivot shaft 27 so as to be rotatable about the horizontal axis (an axis extending in the machine width direction K2). In this manner, the boom 22 is capable of being swung vertically. The arm 23 is pivotally attached to the tip end side of the boom 22 so as to be rotatable around the horizontal axis. As the result, the arm 23 can swing back and forth or up and down. The bucket 24 is provided on the tip end side of the arm 23 and is capable of performing the squeezing operation and the dumping operation.

The working machine 1 can be equipped with another working tool (a hydraulic attachment) configured to be driven by a hydraulic actuator instead of or in addition to the bucket 24. Examples of other working tools include a hydraulic breaker, a hydraulic crusher, an angle broom, an earth auger, a pallet fork, a sweeper, a mower, and a snow blower.

The swing bracket 21 is swingable by the stretching and shortening of the swing cylinder C2 provided inside the machine body 2. The boom 22 is swingable by the stretching and shortening of the boom cylinder C3. The arm 23 is swingable by the stretching and shortening of the arm cylinder C4. The bucket 24 is capable of performing the squeezing operation and the dumping operation through the stretching and shortening of the bucket cylinder (a working tool cylinder) C5. The swing cylinder C2, the boom cylinder C3, the arm cylinder C4, and the bucket cylinder C5 are constituted of hydraulic cylinders (hydraulic actuators).

Next, an attachment structure of the swivel joint 12 in the working machine 1 will be described below.

As shown in FIG. 7 to FIG. 12, the swivel joint 12 has an outer sleeve 13 and an inner shaft 14. The outer sleeve 13 is fixed to the turn base plate 9 and rotates together with the turn base plate 9. The inner shaft 14 is provided so as to be rotatable with respect to the outer sleeve 13 about the turn axis X1 and not to be rotatable with respect to the traveling frame 3A.

First, the configurations of the turn base plate 9 and the traveling frame 3A related to the attachment structure of the swivel joint 12 will be described below.

As shown in FIG. 3 and FIG. 6, the turn base plate 9 has an opening portion 9A (hereinafter, referred to as a "first opening portion 9A") through which the turn axis X1 passes. The first opening portion 9A is a circular opening centered on the turn axis X1. The swivel joint 12 is inserted and attached to the first opening portion 9A. The first opening portion 9A is provided behind the turn motor M3.

Figure 4:
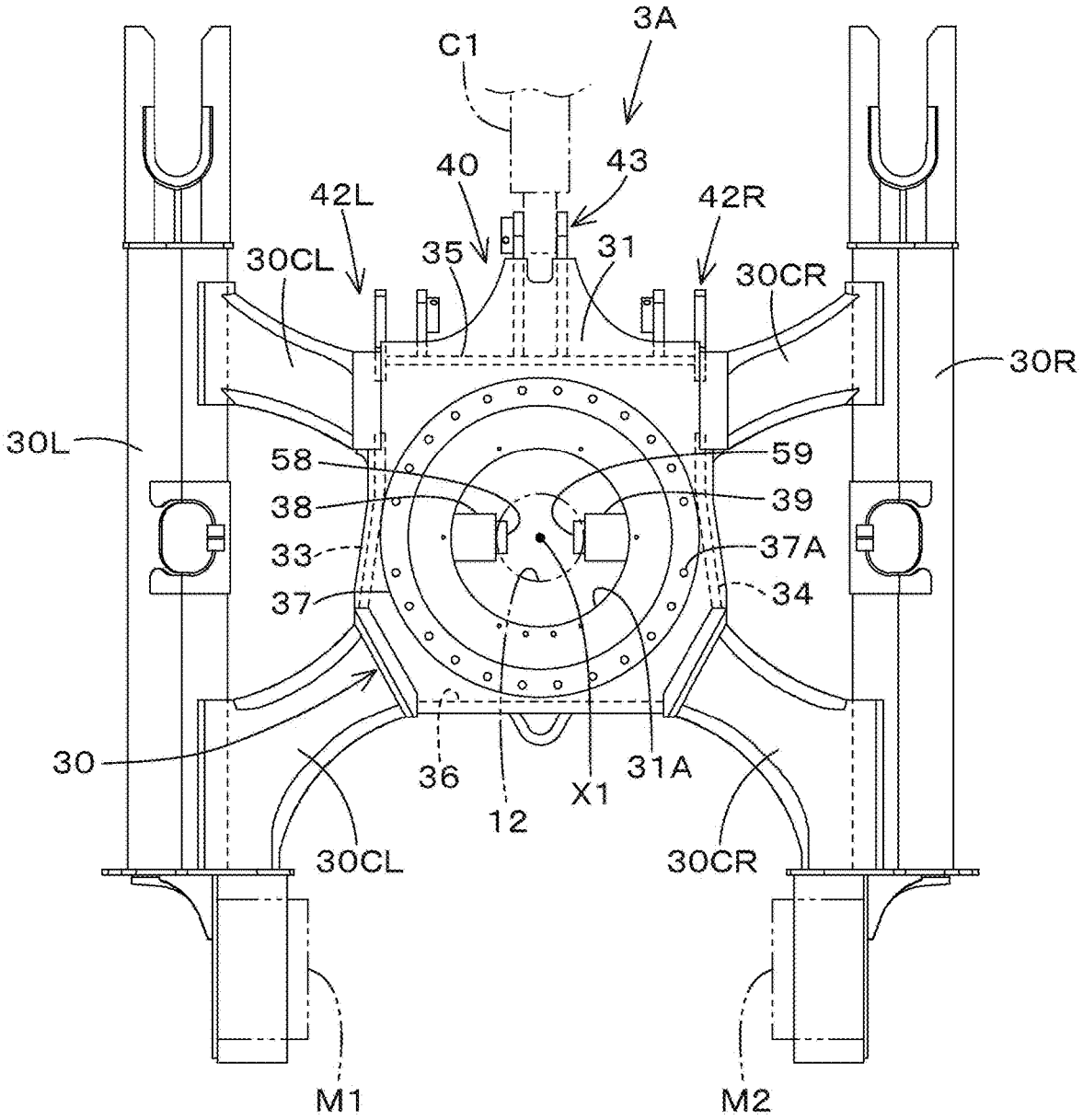
FIG. 4 is a plan view of a traveling frame according to the embodiment.

As shown in FIG. 4 and FIG. 5, the traveling frame 3A has a center frame 30, a left side frame 30L, and a right side frame 30R. The left side frame 30L is located on the left side of the center frame 30. The right side frame 30R is located on the right side of the center frame 30. The front portion of the center frame 30 and the front portion of the left side frame 30L, and the rear portion of the center frame 30 and the rear portion of the left side frame 30L are respectively connected by a left connecting leg 30CL. The front portion of the center frame 30 and the front portion of the right side frame 30R, and the rear portion of the center frame 30 and the rear portion of the right side frame 30R are respectively connected by a right connecting leg 30CR.

The center frame 30 has an upper plate 31, a lower plate 32, a left sidewall 33, a right sidewall 34, a support wall 35, and a rear wall 36. The center frame 30 is formed of an iron plate, a steel plate, or the like.

A support portion 37 having an annular shape is provided on the upper surface of the upper plate 31. The support portion 37 may be a member other than the upper plate 31, or may be integrally formed with the upper plate 31. The support portion 37 has a bolt insertion hole 37A through which a bolt for attaching the inner race 8A of the turn bearing 8 is inserted. The bolt insertion holes 37A are formed in large numbers at intervals on the circumference centered on the turn axis X1. The inner race 8A is fixed on the support portion 37 by the bolt inserted in the bolt insertion hole 37A.

As shown in FIG. 6, the inner race 8A is connected to the outer race 8B with balls 8C, and the outer race 8B is fixed to the lower surface of the turn base plate 9. Thereby, the center frame 30 rotatably supports the machine body 2 with the turn bearing 8.

As shown in FIG. 4 and FIG. 6, the upper plate 31 has an opening portion 31A having a circular shape (hereinafter, referred to as a "second opening portion 31A") centered on the turn axis X1. The lower portion of the swivel joint 12 is inserted into the second opening portion 31A. A first stay 38 and a second stay 39 are attached to the upper plate 31. The first stay 38 extends from the left edge of the second opening portion 31A to the right (in a direction toward the center of the second opening portion 31A). The second stay 39 extends from the right edge of the second opening portion 31A to the left (in a direction toward the center of the second opening portion 31A). The lower portion of the swivel joint 12 is arranged between the tip (the right end) of the first stay 38 and the tip (the left end) of the second stay 39.

As shown in FIG. 5, the lower plate 32 is provided below the upper plate 31 with a gap separating from the upper plate 31. The left sidewall 33 connects the left portion of the upper plate 31 and the left portion of the lower plate 32. The right sidewall 34 connects the right portion of the upper plate 31 and the right portion of the lower plate 32. The support wall 35 connects the front portion of the upper plate 31 and the front portion of the lower plate 32. The rear wall 36 connects the rear portion of the upper plate 31 and the rear portion of the lower plate 32.

As shown in FIG. 4, a dozer bracket 40 for attaching the dozer device 7 is connected to the front portion of the center frame 30. The dozer bracket 40 has dozer support portions 42L and 42R and a cylinder support portion 43. The dozer support portion 42L is provided on the left portion of the support wall 35. The dozer support portion 42R is provided on the right side of the support wall 35. The dozer support portions 42L and 42R support the dozer. The cylinder support portion 43 is provided between the left dozer support portion 42L and the right dozer support portion 42R, and supports the dozer cylinder C1. The dozer support portions 42L and 42R and the cylinder support portion 43 extend forward from the support wall 35.

Next, the outer sleeve 13 and the inner shaft 14 constituting of the swivel joint 12 will be described mainly with reference to FIG. 7 to FIG. 16.

The outer sleeve 13 of the swivel joint 12 has a tubular shape, and the central axis extends vertically and coincides with the turn axis X1.

Figure 7:
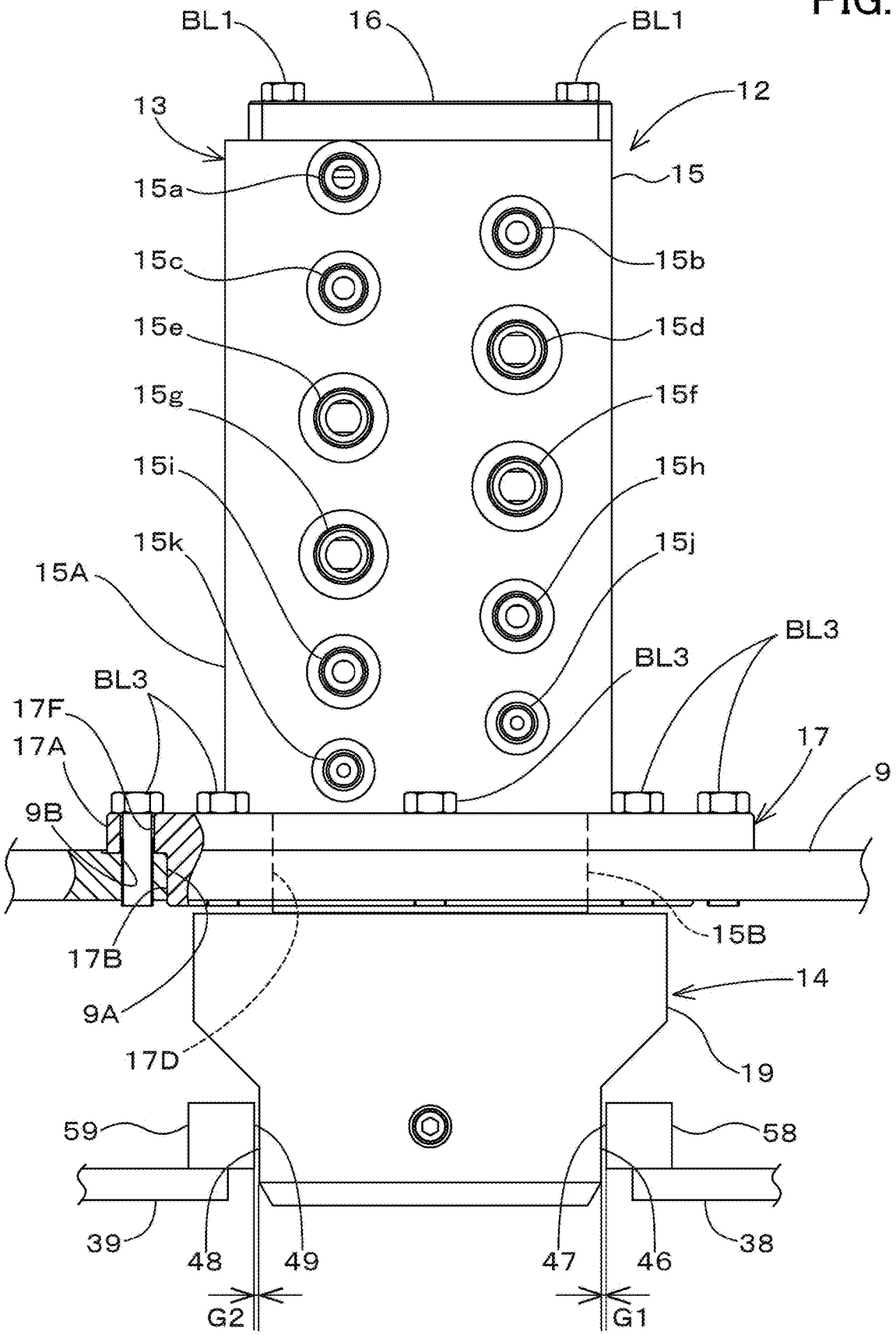
FIG. 7 is a cross-sectional front view illustrating a part of an attachment structure of the swivel joint according to the embodiment.
Figure 9:
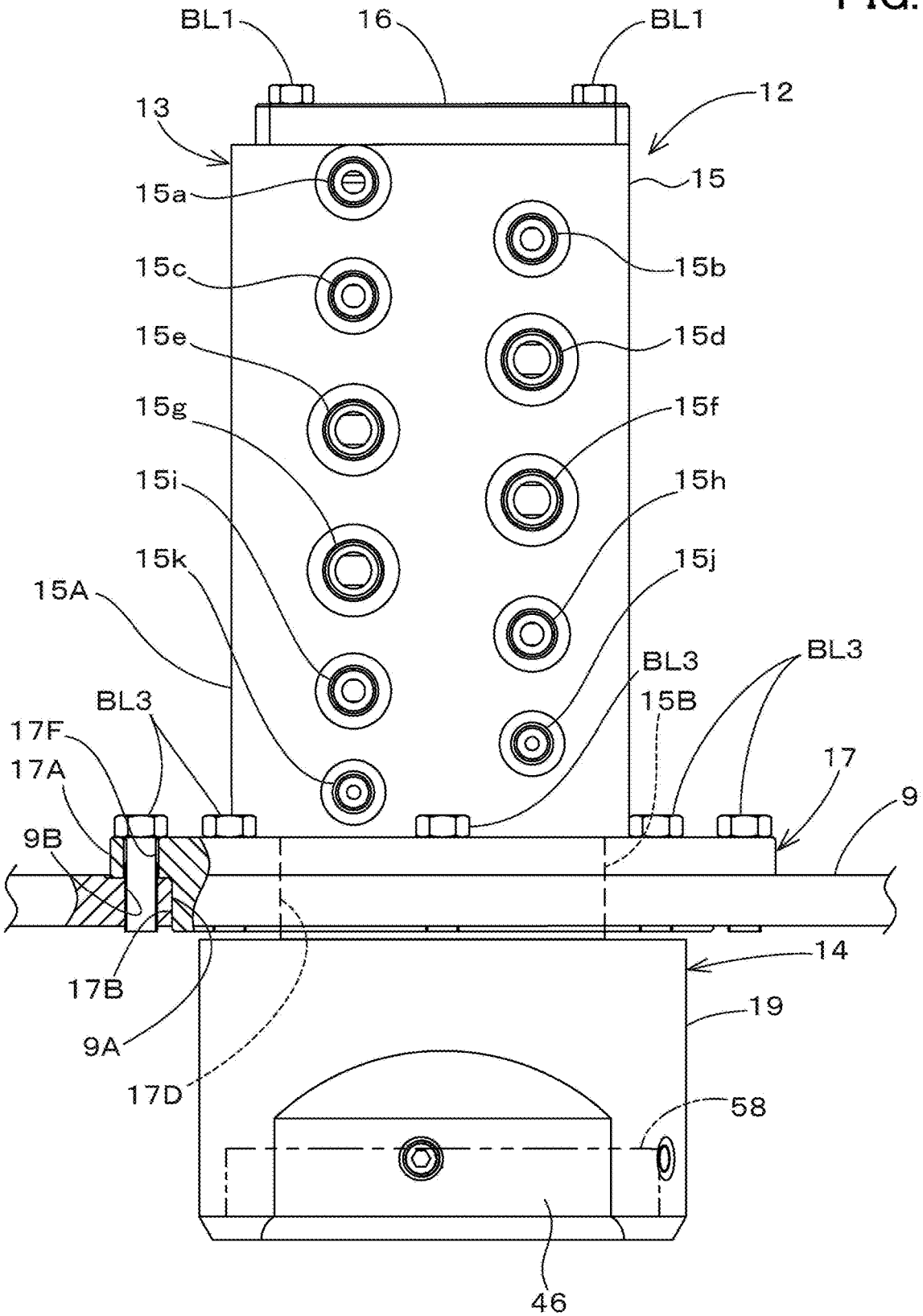
FIG. 9 is a cross-sectional side view illustrating a part of the attachment structure of the swivel joint according to the embodiment.
Figure 10:
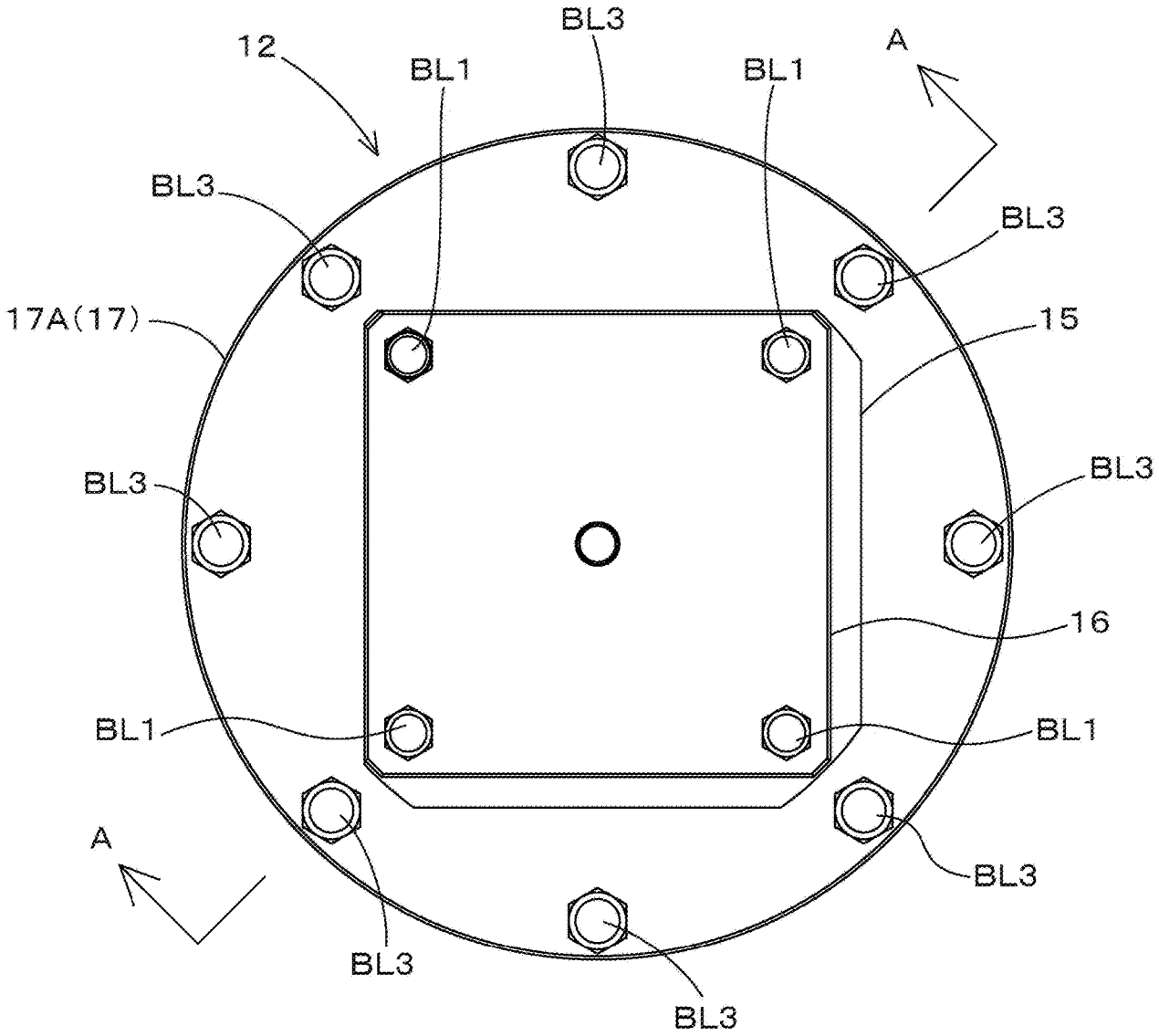
FIG. 10 is a plan view of the swivel joint according to the embodiment.
Figure 11:
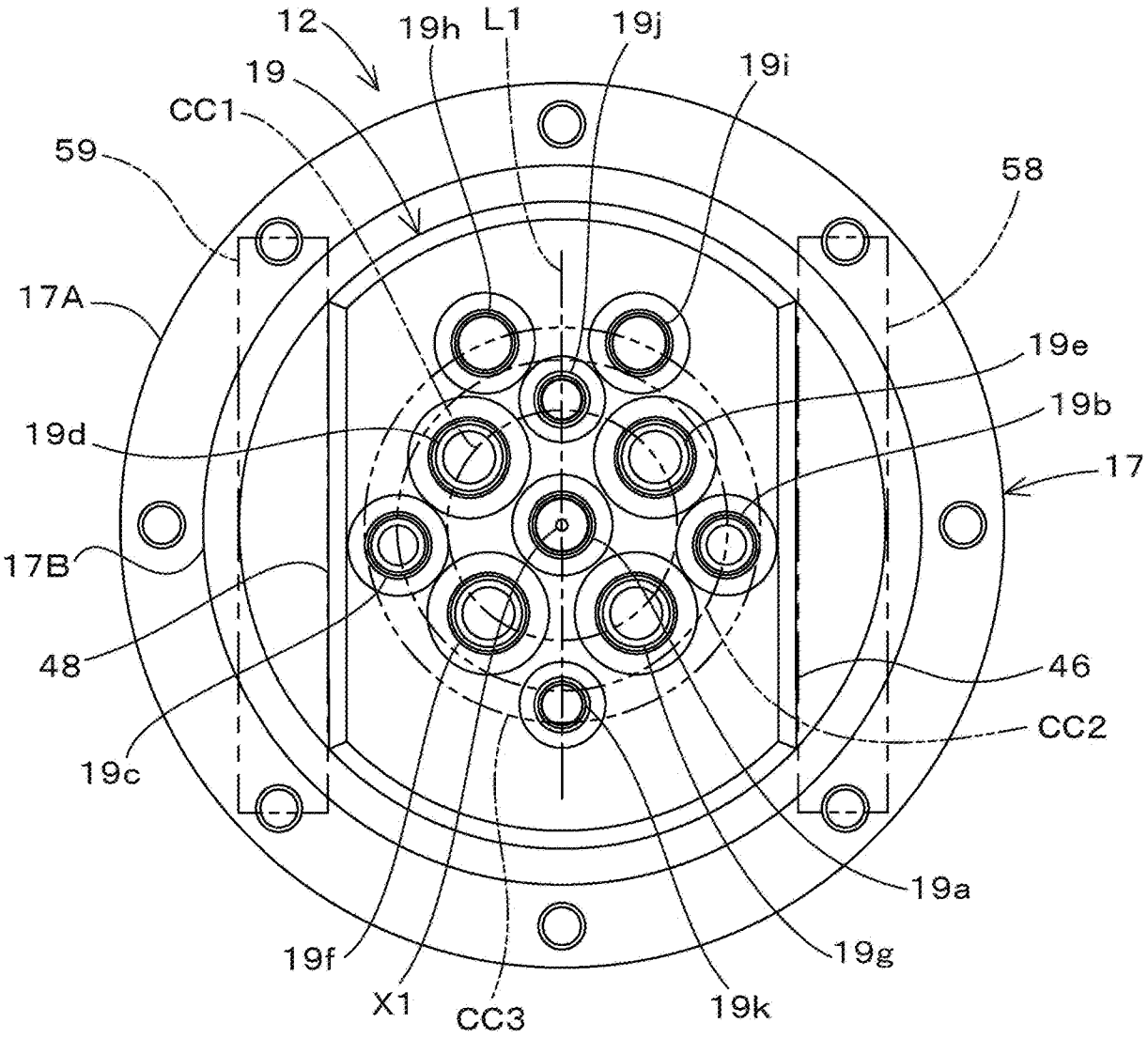
FIG. 11 is a bottom view of the swivel joint according to the embodiment.
Figure 12:
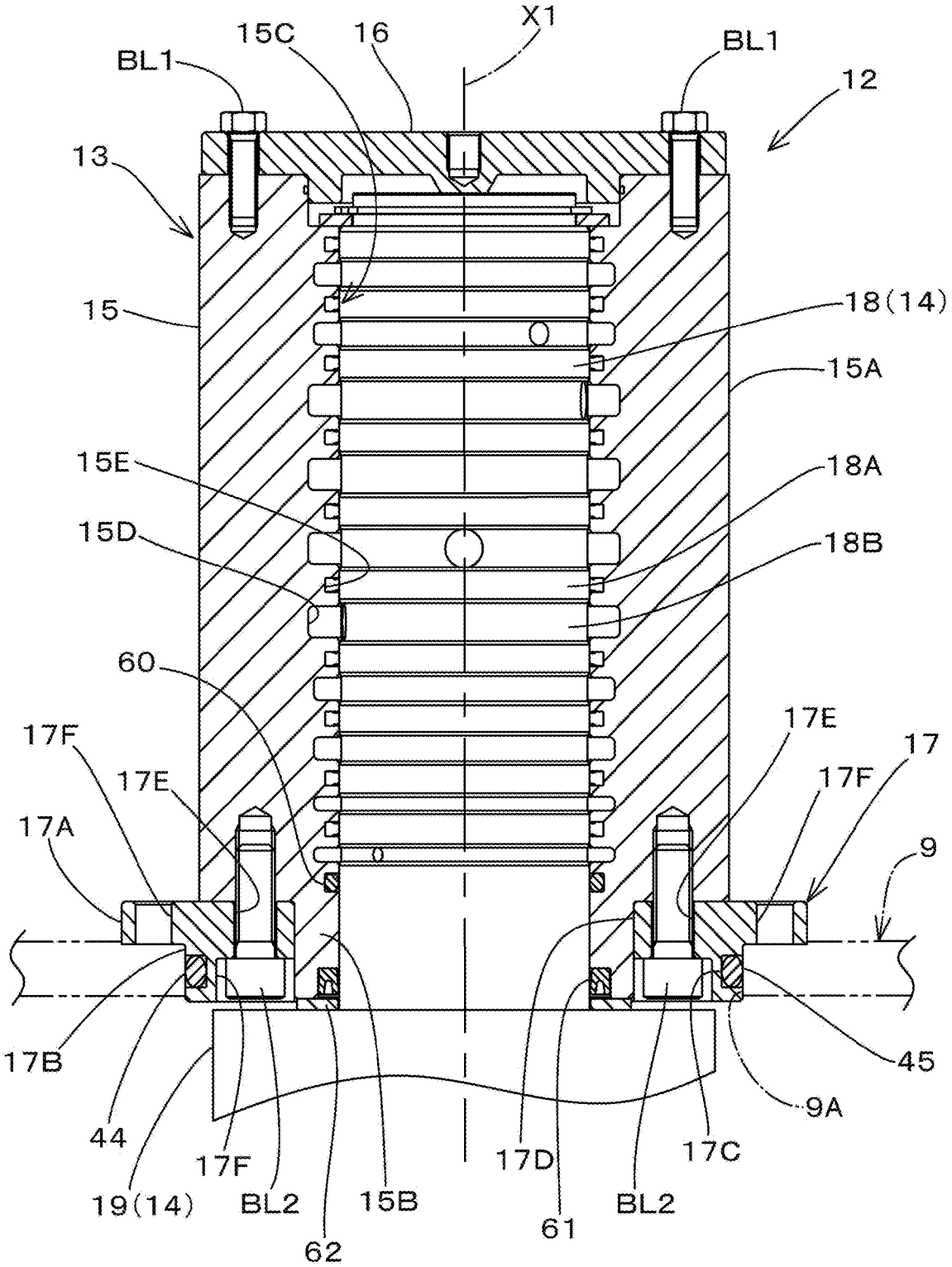
FIG. 12 is a view illustrating an A-A cross-section of FIG. 10 according to the embodiment.

As shown in FIG. 7 and FIG. 9 to FIG. 12, the outer sleeve 13 has a sleeve body 15, an upper member 16, and a lower member 17. As shown in FIG. 7, FIG. 9, and FIG. 12, the sleeve body 15 has an upper tubular portion 15A and a lower tubular portion 15B. The sleeve body 15 has an internal hole 15C having a substantially-cylindrical shape that vertically penetrates the upper cylinder portion 15A and the lower cylinder portion 15B. The upper tubular portion 15A has a rectangular tubular shape, and a plurality of annular grooves are formed on the inner surface (on the inner circumferential surface of the inner hole 15C). As shown in FIG. 12, the plurality of annular grooves include large-diameter grooves 15D and small-diameter grooves 15E alternately arranged in the axial direction (in the vertical direction). The lower tubular portion 15B is formed in a cylindrical shape. The outer diameter of the lower tubular portion 15B is smaller than the distance between two opposing outer surfaces of the upper tubular portion 15A. The upper cylinder portion 15A is arranged above the turn base plate 9. The lower tubular portion 15B has an upper portion arranged above the turn base plate 9, and has a lower portion arranged inside the first opening portion 9A of the turn base plate 9.

As shown in FIG. 7 and FIG. 9, a plurality of connection ports (ports) 15*a* to 15*k* to which the pipes (the hydraulic hoses) are connected are formed on the outer circumferential surface of the upper cylinder portion 15A of the sleeve body 15. The pipes connected to the connection ports 15*a* to 15*k* are connected to the hydraulic pump P1 with the control valve V1.

As shown in FIG. 9, FIG. 10, FIG. 12, and the like, the upper member 16 is fixed to the upper portion of the sleeve main body 15 by bolts BL1. The upper member 16 closes the upper portion of the inner hole 15C of the sleeve body 15.

As shown in FIG. 12, the lower member 17 is fixed to the lower portion of the sleeve body 15 by bolts BL2. As shown in FIG. 7, FIG. 9, FIG. 11, and FIG. 12, the lower member 17 has a flange portion 17A and an insertion portion 17B. The flange portion 17A is formed to have an annular shape. As shown in FIG. 3 and FIG. 12, the center of the flange portion 17A is located on the turn axis X1. The outer diameter of the flange portion 17A is larger than the outer diameter of the first opening portion 9A of the turn base plate 9. The outer circumferential edge of the flange portion 17A is located outside the outer edge of the sleeve main body 15 (a position separating away from the turn axis X1).

Figure 13:
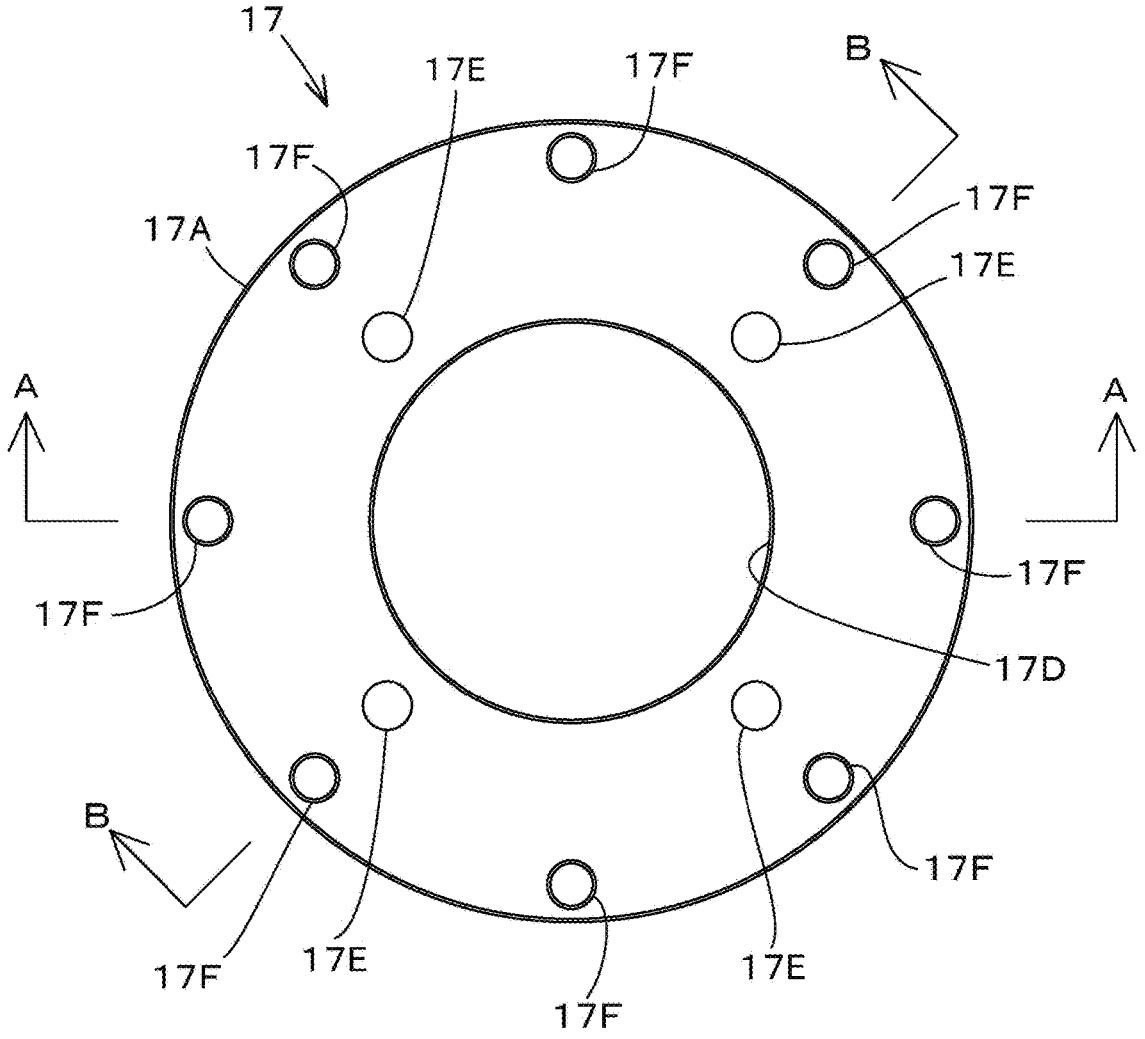
FIG. 13 is a plan view of a lower member according to the embodiment.
Figure 14:
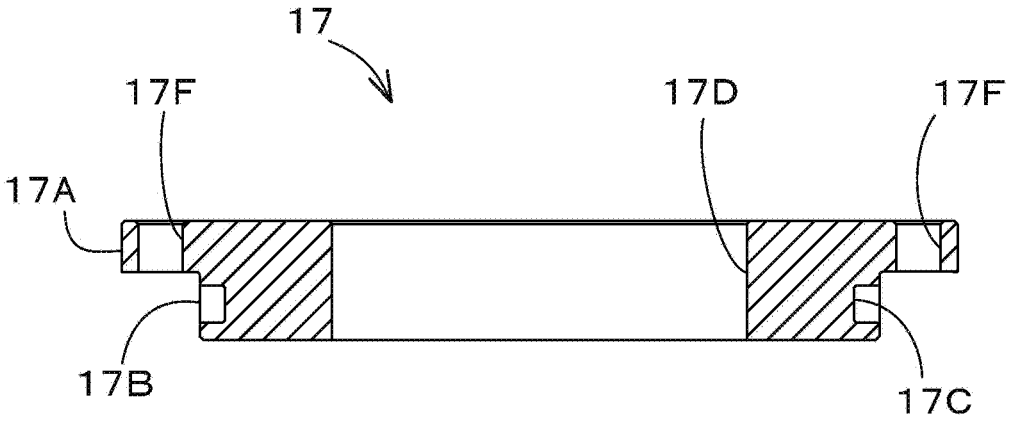
FIG. 14 is a view illustrating an A-A cross-section of FIG. 13 according to the embodiment.
Figure 15:
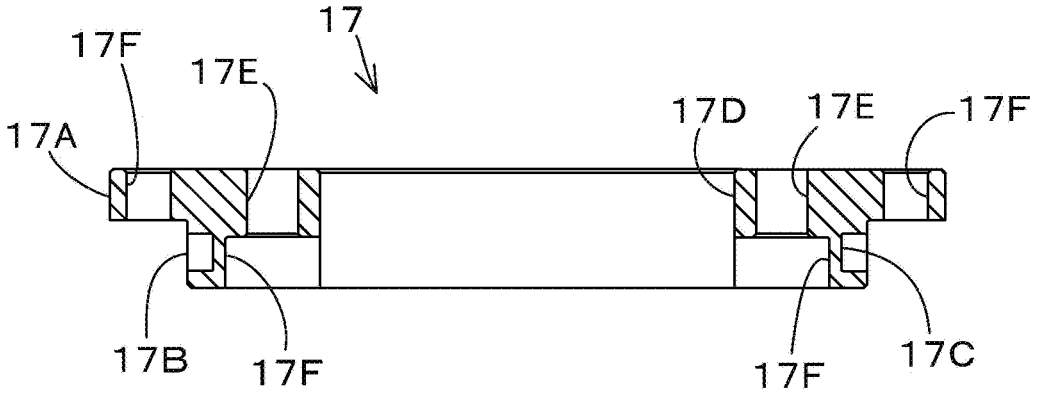
FIG. 15 is a view illustrating a B-B cross-section of FIG. 13 according to the embodiment.

As shown in FIG. 6, FIG. 7, FIG. 9, and the like, the lower surface of the flange portion 17A is in contact with the upper surface of the turn base plate 9 around the first opening portion 9A of the turn base plate 9. As shown in FIG. 13 to FIG. 15, and the like, the flange portion 17A is formed with a bolt insertion hole 17F into which a bolt is inserted. The bolt through holes 17F are formed in large numbers at intervals on a circumference centered on the turn axis X1. As shown in FIG. 7 and FIG. 9, the bolt BL3 inserted into the bolt insertion hole 17F is screwed into the screw hole 9B formed around the first opening portion 9A. In this manner, the flange portion 17A is fixed to the turn base plate 9 around the first opening portion 9A, and covers the first opening portion 9A. In other words, the flange portion 17A closes the gap formed between the first opening portion 9A and the swivel joint 12 (covers the gap). In this manner, that configuration prevents tools, parts, fluid, dust, and the like from falling into the traveling frame 3A from the first opening portion 9A.

As shown in FIG. 11, FIG. 12, and the like, the insertion portion 17B has an annular shape and is provided below the flange portion 17A. The insertion portion 17B is formed integrally with the flange portion 17A. The outer diameter of the insertion portion 17B is smaller than the outer diameter of the flange portion 17A, and is less than or equal to the outer diameter of the first opening portion 9A of the turn base plate 9. As shown in FIG. 6 and FIG. 12, the insertion portion 17B is inserted into the first opening portion 9A from above.

Figure 16:
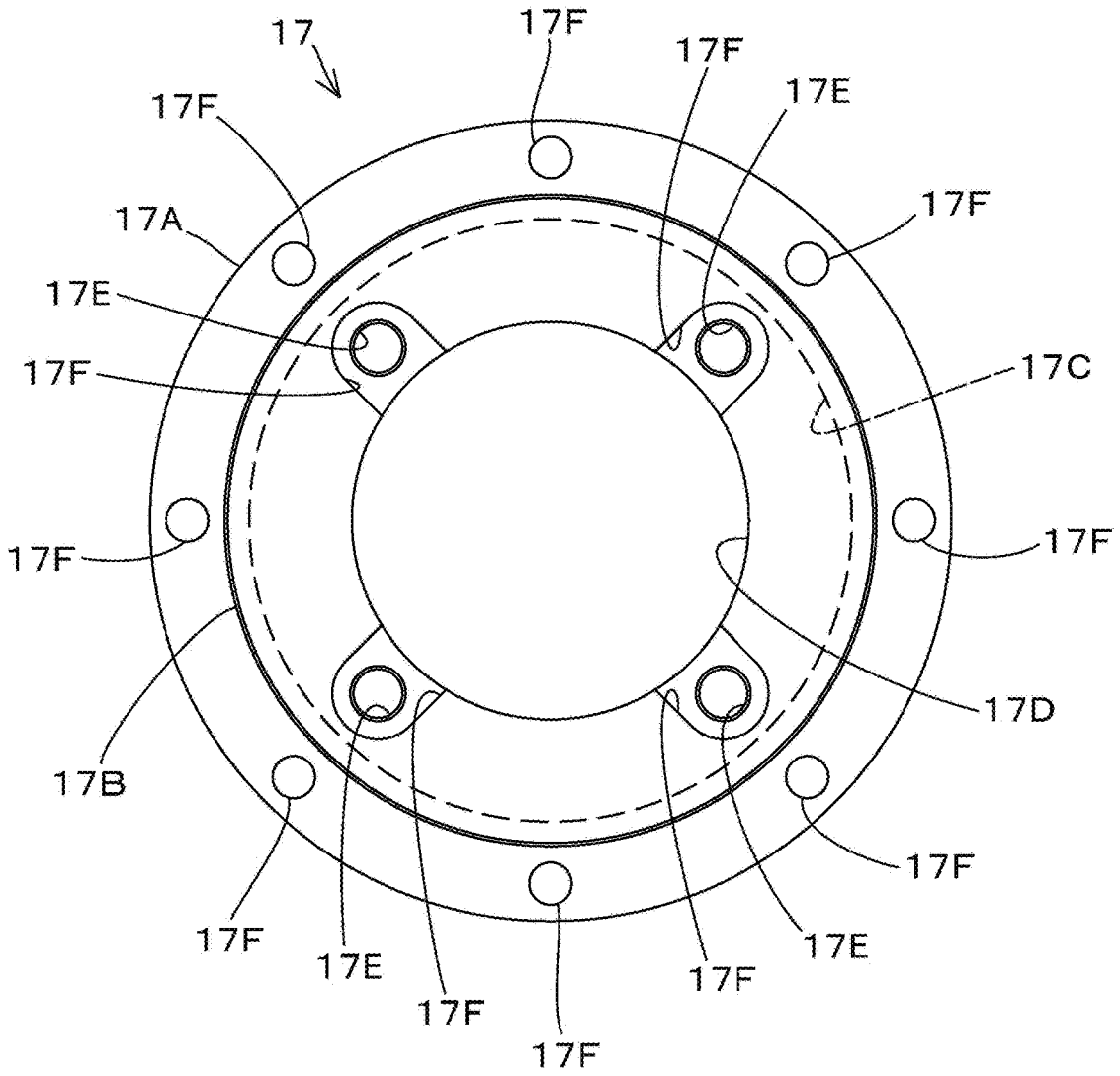
FIG. 16 is a bottom view of the lower member according to the embodiment.

As shown in FIG. 12, a first seal portion 44 is provided on the outer circumferential surface of the insertion portion 17B. The first seal portion 44 seals a gap between the outer circumferential surface of the insertion portion 17B and the inner circumferential surface of the first opening portion 9A. That is, the outer sleeve 13 has, on the surface facing the turn base plate 9, the first seal portion 44 that seals a gap between the outer sleeve 13 and the turn base plate 9. The first seal portion 44 has a first seal member 45 attached to the outer circumferential surface of the insertion portion 17B. As shown in FIG. 14 to FIG. 16, an annular groove 17C is formed on the outer circumferential surface of the insertion portion 17B, and the first seal member 45 is attached to the groove 17C. The first seal member 45 is made of, for example, an annular seal material such as an O-ring. The first seal portion 44 seals a gap between the outer circumferential surface of the insertion portion 17B and the inner circumferential surface of the first opening portion 9A. That configuration prevents fluid, dust, and the like from falling into the traveling frame 3A from the gap between the outer circumferential surface of the insertion portion 17B and the inner circumferential surface of the first opening portion 9A.

Although the lower member 17 according to the embodiment has the flange portion 17A and the insertion portion 17B, the lower member 17 may have only the flange portion 17A without the insertion portion 17B. Even when the lower member 17 does not have the insertion portion 17B, the flange portion 17A is capable of providing an effect of preventing tools, parts, fluid, dust, and the like from falling from the first opening portion 9A to the traveling frame 3A.

In addition, in the present embodiment, the gap between the insertion portion 17B and the first opening portion 9A is sealed by providing the insertion portion 17B of the lower member 17 to the first seal portion 44, but not limited to this configuration. For example, a seal portion may be provided on the lower surface of the flange portion 17A to seal a gap between the flange portion 17A and the upper surface of the turn base plate 9. In addition, a seal portion may be provided on both of the insertion portion 17B and the flange portion 17A to seal between a gap the outer sleeve 13 and the turn base plate 9.

As shown in FIG. 13 to FIG. 16, a center hole 17D is formed at the center of the lower member 17. The center hole 17D vertically penetrates the flange portion 17A and the insertion portion 17B. As shown in FIG. 12, the upper portion of the inner shaft 14 is inserted into the center hole 17D. As shown in FIG. 13 and FIG. 16, a plurality of through holes 17E are formed radially outside the center hole 17D of the lower member 17. Four through-holes 17E are formed at intervals on the circumference centered on the turn axis X1. As shown in FIG. 15, the through hole 17E vertically penetrates the flange portion 17A and the insertion portion 17B. A spot facing portion 17F is formed below the through hole 17E. As shown in FIG. 12, the bolt BL2 is inserted into the through hole 17E. When the bolt BL2 is inserted into the through hole 17E, the head of the bolt BL2 is located in the spot facing portion 17F, and thus does not protrude from the lower surface of the lower member 17. The lower member 17 is fixed to the lower portion of the sleeve body 15 by the bolt BL2.

In the present embodiment, although the lower member 17 is a member different from the sleeve body 15, the lower member 17 may be formed integrally with the sleeve body 15 through the casting or the like. In the case where the lower member 17 is formed integrally with the sleeve body 15, the through hole 17E and the bolt BL2 are unnecessary.

As shown in FIG. 12, the inner shaft 14 is inserted into the center hole 17D of the lower member 17, and is inserted into the inner hole of the sleeve body 15. The inner shaft 14 has a substantially columnar shape, and has a central axis extending in the vertical direction and coinciding with the turn axis X1.

As shown in FIG. 12, the inner shaft 14 has an upper shaft portion 18 and a lower shaft portion 19. The upper shaft portion 18 has a large diameter portion 18A and a small diameter portion 18B. The large diameter portion 18A and the small diameter portion 18B are formed alternately in the axial direction (in the vertical direction). The large diameter portion 18A and the small diameter portion 18B are respectively arranged in a plurality of annular grooves formed on the inner circumferential surface of the sleeve body 15. The large diameter portion 18A is arranged in the small diameter groove 15E. The small diameter portion 18B is arranged in the large diameter groove 15D. The lower portion of the upper shaft portion 18 is inserted through the center hole 17D of the lower member 17 of the outer sleeve 13 and through the first opening portion 9A of the turn base plate 9.

As shown in FIG. 12, the seal members 60 and 61 are arranged between the outer circumferential surface of the upper shaft portion 18 and the inner circumferential surface of the sleeve body 15. The seal member 60 is arranged between the outer circumferential surface of the upper shaft portion 18 and the inner circumferential surface of the upper cylindrical portion 15A of the sleeve body 15. The seal member 61 is arranged between the outer circumferential surface of the upper shaft portion 18 and the inner circumferential surface of the lower tubular portion 15B of the sleeve body 15.

The lower shaft portion 19 is formed integrally with the upper shaft portion 18, and extends downward from the lower portion of the upper shaft portion 18. The lower shaft portion 19 is formed to have a columnar shape having a smaller diameter than the diameter of the first opening portion 9A of the turn base plate 9, and is arranged below the turn base plate 9. A interposition member 62 having a flat annular shape is provided between the upper surface of the lower shaft portion 19 and the lower surface of the outer sleeve 13. The interposition member 62 fills the gap between the upper surface of the lower shaft portion 19 and the lower surface of the outer sleeve 13.

As shown in FIG. 7, FIG. 9 and FIG. 11, a first flat portion 46 and a third flat portion 48 are provided on the outer circumferential surface of the lower shaft portion 19. The first flat portion 46 and the third flat portion 48 are formed by cutting out the lowermost portion of the outer circumferential surface of the lower shaft portion 19. The third flat portion 48 is provided at a position different from the first flat portion 46 in the circumferential direction of the outer circumferential surface of the lower shaft portion 19. In particular, the first flat portion 46 and the third flat portion 48 are provided at the same position (the same height) in the axial direction of the inner shaft 14 and are different by 180° in the circumferential direction. In the case of the present embodiment, the first flat portion 46 is provided on the left side of the outer circumferential surface of the lower shaft portion 19, and the third flat portion 48 is provided on the right side of the outer circumferential surface of the lower shaft portion 19. The first flat portion 46 and the third flat portion 48 are surfaces parallel to each other, and extend in the front-rear direction. The lengths of the first flat portion 46 and the third flat portion 48 in the front-rear direction are longer than the radius of the lower shaft portion 19.

Figure 8:
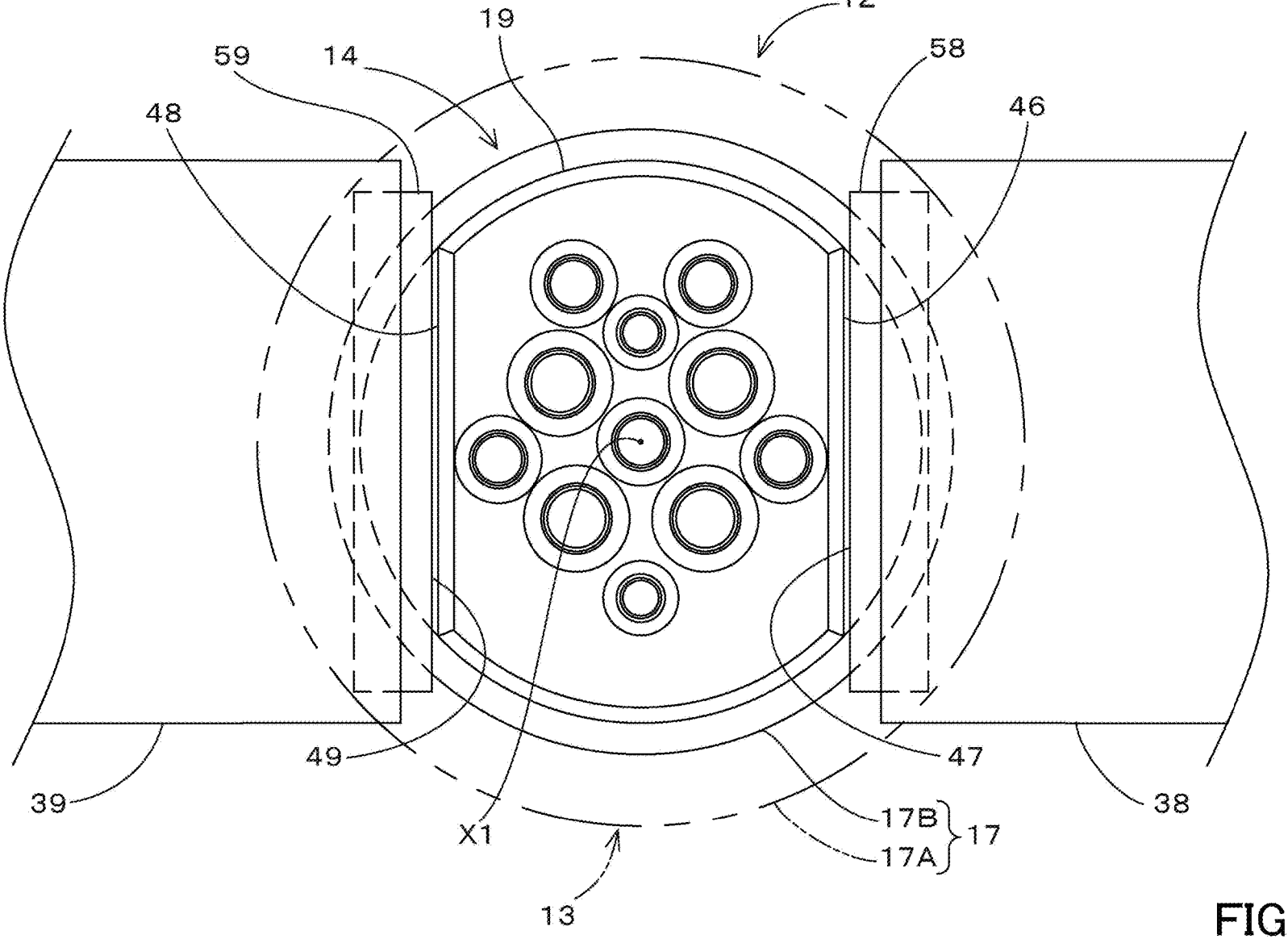
FIG. 8 is a bottom view illustrating the attachment structure of the swivel joint according to the embodiment.

As shown in FIG. 7 and FIG. 8, the traveling frame 3A includes a second flat portion 47 facing the first flat portion 46 and includes a fourth flat portion 49 facing the third flat portion 48. As shown in FIG. 4, FIG. 7, and FIG. 8, the second flat portion 47 is provided on the first member 58 fixed to the first stay 38 of the traveling frame 3A. The fourth flat portion 49 is provided on the second member 59 fixed to the second stay 39 of the traveling frame 3A. The first member 58 is a rectangular parallelepiped member, and extends to the left of the second opening portion 31A in the front-rear direction. The second member 59 is a rectangular parallelepiped member, and extends to the right of the second opening portion 31A in the front-rear direction. The second flat portion 47 is the left side surface of the first member 58. The fourth flat portion 49 is the right side surface of the second member 59. The second flat portion 47 and the fourth flat portion 49 face each other with the turn axis X1 interposed therebetween. The second flat portion 47 and the fourth flat portion 49 are planes parallel to each other, and extend in the front-rear direction.

The first member 58 has only to have the second flat portion 47, and the shape is not limited to the rectangular parallelepiped shape. The second member 59 only needs to have the fourth flat portion 49, and the shape thereof is not limited to the rectangular parallelepiped shape. In addition, the first member 58 and the second member 59 may be connected to form an integral member. In addition, the first member 58 may be a member integrated with the first stay 38, and the second member 59 may be a member integrated with the second stay 39.

Additionally in the case of the present embodiment, the first flat portion 46, the second flat portion 47, the third flat portion 48, and the fourth flat portion 49 are formed as surfaces extending in the front-rear direction, but may be formed as surfaces extending in other directions (for example, extending in the machine width direction).

In a state in which the turn base plate 9 shown in FIG. 1 and FIG. 2 does not turn with respect to the traveling frame 3A (a state in which the operator seat 7 faces forward), the first flat portion 46 and the second flat portion 47 are in contact with each other. Alternatively, the third flat portion 48 and the fourth flat portion 49 are in contact with or close to each other. In particular, a configuration where the first flat portion 46 and the second flat portion 47 are close to each other and the third flat portion 48 and the fourth flat portion 49 are close to each other (a first configuration), a configuration where either one of a pair of the first flat portion 46 and the second flat portion. 47 and a pair of the third flat portion 48 and the fourth flat portion 49 is in contact with each other and the other is in proximity with each other (a second configuration), or a configuration where the first flat portion 46 and the second flat portion. 47 are contact with each other and the third flat portion 48 and the fourth flat portion 49 are in contact with each other (a third configuration) is employed.

As shown in FIG. 7, in the case of the embodiment, the first configuration is employed. In particular, the first flat portion 46 and the second flat portion 47 are close to each other, and a gap G1 is formed between the first flat portion 46 and the second flat portion 47. The third flat portion 48 and the fourth flat portion 49 are close to each other, and a gap G2 is formed between the third flat portion 48 and the fourth flat portion 49. It is preferable that the gaps G1 and G2 are each set to about several mm (for example, about 1 mm to 3 mm). The gaps G1 and G2 serve as clearances (spaces) that facilitate the operation of inserting the lower shaft portion 19 of the inner shaft 14 between the second flat portion 47 and the fourth flat portion 49. The gaps G1 and G2 allow the inner shaft 14 to rotate about the turn axis X1 only by a slight angle (for example, about 1° to 3°), but do not allow free rotation.

Figure 17:
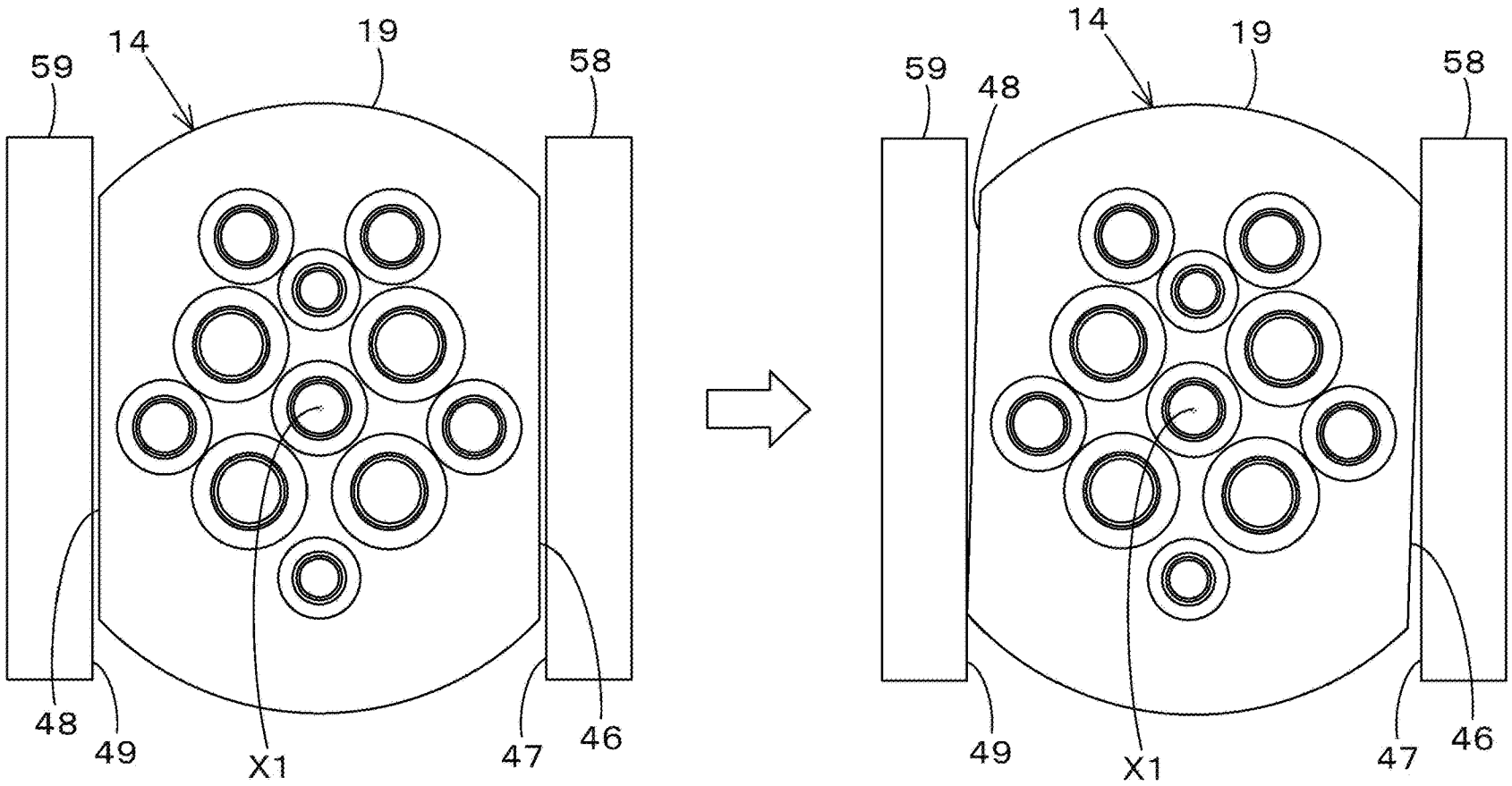
FIG. 17 is an explanation view illustrating action of a turn restrictor mechanism according to the embodiment.

When the outer sleeve 13 rotates about the turn axis X1 together with the turn base plate 9 from the state where the first flat portion 46 faces the second flat portion 47 and is close to the second flat portion 47 and the third flat portion 48 faces the fourth flat portion 49 and is close to the fourth flat portion 49 (see the left diagram of FIG. 17), the first flat portion 46 comes into contact with the second flat portion 47 and the third flat portion 48 comes into contact with the fourth flat portion 49 (see the right diagram of FIG. 17). In this manner, the rotation of the inner shaft 14 is restricted (blocked). As described above, the first flat portion 46, the second flat portion 47, the third flat portion 48, and the fourth flat portion 49 constitute a turn restrictor mechanism for restricting the rotation of the inner shaft 14 with respect to the traveling frame 3A (for making the inner shaft non-rotatable).

As described above, in the case of the present embodiment, the turn restrictor mechanism has two flat portions (the first flat portion 46 and the third flat portion 48) provided on the inner shaft 14 and has two flat portions (the second flat portion 47 and the fourth flat portion 49) provided on the traveling frame 3A. However, the configuration of the turn restrictor mechanism is not limited thereto.

For example, the turn restrictor mechanism may be constituted of one flat portion provided on the inner shaft 14 and one flat portion provided on the traveling frame 3A. One flat portion (for example, the first flat portion 46) provided on the inner shaft 14 and one flat portion (for example, the second flat portion 47) provided on the traveling frame 3A are provided at positions facing each other. In this case, the rotation of the inner shaft 14 with respect to the traveling frame 3A is restricted by the contact of the one flat portion provided on the traveling frame 3A with the one flat portion provided on the inner shaft 14.

In addition, for example, the turn restrictor mechanism may be constituted of three or more flat portions provided on the inner shaft 14 and three or more flat portions provided on the traveling frame 3A. The three or more flat portions provided on the inner shaft 14 and the three or more flat portions provided on the traveling frame 3A are provided at positions facing each other. As an example, the turn restrictor mechanism may employ a configuration where four flat portions are provided on the inner shaft 14 at the same position (the same height) in the axial direction of the inner shaft 14 and at positions different by 90° in the circumferential direction and where the traveling frame 3A is provided with other four flat portions at positions facing the other four flat portions. In this case, the rotation of the inner shaft 14 with respect to the traveling frame 3A is restricted by contacting the four flat portions provided on the traveling frame 3A with the four flat portions provided on the inner shaft 14.

As shown in FIG. 11, the lower surface of the lower shaft portion 19 of the inner shaft 14 is provided with a plurality of connection ports (ports) 19*a* to 19*k* to which pipes (hydraulic hoses) connected to hydraulic equipment arranged below the turn base plate 9 are connected. The connection ports 19*a* to 19*k* communicate with the connection ports 15*a* to 15*k* through a fluid tube formed inside the sleeve body 15. In particular, the connection port 19*a* communicates with the connection port 15*a*. The connection port 19*b* communicates with the connection port 15*b*. The connection port 19*c* communicates with the connection port 15*c*. The connection port 19*d* communicates with the connection port 15*d*. The connection port 19*e* communicates with the connection port 15*e*. The connection port 19*f* communicates with the connection port 15*f*. The connection port 19*g* communicates with the connection port 15*g*. The connection port 19*h* communicates with the connection port 15*h*. The connection port 19*i* communicates with the connection port 15*i*. The connection port 19*j* communicates with the connection port 15*j*. The connection port 19*k* communicates with the connection port 15*k*.

A drain pipe for returning the return fluid from the first traveling motor M1 and the second traveling motor M2 to the operation fluid tank T2 is connected to the connection port 19*a*. A pipe for circulating the operation fluid used to shorten the angle cylinder is connected to the connection port 19*b*. A pipe through which the operation fluid for extending the angle cylinder is circulated is connected to the connection port 19*c*. The connection port 19*d* is connected to a pipe through which the operation fluid for backward traveling of the second traveling motor M2 flows. The connection port 19*e* is connected to a pipe that circulates the operation fluid for reverse traveling of the first traveling motor M1. The connection port 19*f* is connected to a pipe through which the operation fluid for forward driving of the second traveling motor M2 is circulated. The connection port 19*g* is connected to a pipe through which the operation fluid for forward driving of the first traveling motor M1 flows. A pipe for circulating the operation fluid for shortening the dozer cylinder C1 is connected to the connection port 19*h*. A pipe that circulates the operation fluid for extending the dozer cylinder C1 is connected to the connection port 19*i*. The connection port 19*j* is connected to a pipe through which the operation fluid for transmitting the boom operating pilot pressure for releasing the holding lock valve of the dozer cylinder C1 is circulated. The connection port 19*k* is connected to a pipe through which the operation fluid for shifting the first traveling motor M1 and the second traveling motor M2 flows.

Referring to FIG. 11, the arrangement of the plurality of connection ports 19*a* to 19*k* in the lower shaft portion 19 will be described. One connection port (the connection port 19*a*) is arranged such that the center thereof is located at the turn axis X1. Four connection ports 19*d*, 19*e*, 19*f*, and 19*g* are arranged around the connection port 19*a* such that the centers of the connection ports 19*d*, 19*e*, 19*f*, and 19*g* are located on a concentric circle CC1 whose center is the turn axis X1. The four connection ports 19*d*, 19*e*, 19*f*, and 19*g* are arranged such that the intervals between the adjacent connection ports are uneven in the direction along the concentric circle CC1. In particular, the distance between the connection ports 19*d* and 19*e* is the largest, the distance between the connection ports 19*d* and 19*f* and the distance between the connection ports 19*e* and 19*g* are the second largest, and the distance between the connection ports 19*f* and 19*g* are the smallest.

A connection port 19*j* is arranged between the connection port 19*d* and the connection port 19*e* in the direction around the turn axis X1. The connection port 19*c* is arranged between the connection port 19*d* and the connection port 19*f*. The connection port 19*b* is arranged between the connection port 19*e* and the connection port 19*g*. The connection port 19*k* is arranged between the connection port 19*f* and the connection port 19*g*. The connection port 19*j* is arranged at a position overlapped with the concentric circle CC1. The connection ports 19*b*, 19*c*, 19*k* are arranged outside the concentric circle CC1. That is, the connection port 19*j* is located closer to the turn axis X1 than the connection ports 19*b*, 19*c*, 19*k*. The center of the connection port 19*j* and the center of the connection port 19*k* are arranged on the same straight line L1 that extends in the front-rear direction through the turn axis X1. The distance between the center of the connection port 19*j* and the turn axis X1 is shorter than the distance between the center of the connection port 19*k* and the turn axis X1, shorter than the distance between the center of the connection port 19*b* and the turn axis X1, and shorter than the distance between the center of the connection port 19*c* and the turn axis X1.

The connection port 19*h* is arranged between the connection port 19*d* and the connection port 19*j* in the direction around the turn axis X1. The connection port 19*i* is arranged between the connection port 19*e* and the connection port 19*j* in the direction around the turn axis X1. The connection ports 19*h* and 19*i* are arranged at positions outside the other connection ports (the connection ports other than the connection ports 19*h* and 19*i*) (arranged at positions separating from the turn axis X1). The centers of the connection ports 19*b* and 19*c* are arranged on a concentric circle CC2 centered on the turn axis X1. The centers of the connection ports 19*h* and 19*i* are arranged on a concentric circle CC3 centered on the turn axis X1. The relation between the diameters of the concentric circles CC1, CC2, CC3 is represented by CC1<CC2<CC3. The diameters of the connection ports 19*b*, 19*c*, 19*j*, and 19*k* are smaller than the diameters of the other connection ports 19*a*, 19*d*, 19*e*, 19*f*, 19*g*, 19*h*, and 19*i*.

The connection ports 19*a* to 19*k* can be arranged in a narrow space on the bottom surface of the lower shaft portion 19 by arranging the plurality of connection ports 19*a* to 19*k* as described above. Thus, even in the configuration in which the outer circumferential surface of the lower shaft portion 19 is cut out to form the flat portions (the first flat portion 46 and the third flat portion 48), the connection ports 19*a* to 19*k* can be surely arranged on the bottom surface of the lower shaft portion 19.

As shown in FIG. 6, a grease bath 50 is provided between the turn base plate 9 and the traveling frame 3A. The grease bus 50 is arranged below the turn base plate 9 and above the traveling frame 3A.

The grease bath 50 has an upper tubular portion 51, a first horizontal portion 52, an inclined portion 53, a second horizontal portion 54, and a lower tubular portion 55. The upper cylindrical portion 51 is arranged along the outer circumferential surface of the upper portion of the lower shaft portion 19 of the inner shaft 14. The first horizontal portion 52 extends outward from the upper tubular portion 51 (separates away from the turn axis X1). The inclined portion 53 extends obliquely downward from the outer end portion of the first horizontal portion 52. In particular, the inclined portion 53 extends so as to move downward as it is separated from the inner shaft 14. The second horizontal portion 54 extends outward from the lower end of the inclined portion 53. The lower tubular portion 55 extends downward from the outer end of the second horizontal portion 54 along the inner circumferential surface of the support portion 37.

The space S1 surrounded by the upper tubular portion 51 of the grease bath 50, the first horizontal portion 52, the inclined portion 53, the second horizontal portion 54, the turn base plate 9 and the turn bearing 8 is filled with the grease to form a grease reservoir. The inner race 8A of the turn bearing 8 and the pinion 11 attached to the output shaft of the slewing motor M3 is engaged with each other in the grease reservoir, thereby ensuring the lubricity between the inner race 8A and the pinion 11.

As shown in FIG. 6, the second seal portion 56 is provided on the outer circumferential surface of the lower shaft portion 19 of the inner shaft 14. The second seal portion 56 is provided below the turn base plate 9 and above the turn restrictor mechanism (the first flat portion 46, the second flat portion 47, the third flat portion 48, the fourth flat portion 49). The second seal portion 56 seals a gap between the outer circumferential surface of the inner shaft 14 and the inner circumferential surface of the grease bath 50. In particular, the second seal portion 56 seals a gap between the outer circumferential surface of the lower shaft portion 19 of the inner shaft 14 and the inner circumferential surface of the upper tubular portion 51 of the grease bath 50. The second seal portion 56 has a second seal member 57 attached to the outer circumferential surface of the lower shaft portion 19. An annular groove 19A is formed on the outer circumferential surface of the lower shaft portion 19, and the second seal member 57 is attached to a concave groove 19A. The second seal member 57 is made of, for example, an annular seal material such as an O-ring. The outer circumferential surface of the lower shaft portion 19 and the inner circumferential surface of the grease bath 50 are sealed by the second seal portion 56, and thus it is possible to prevent the grease and the fluid from leaking out between the inner shaft 14 and the grease bath 50.

The configuration of the second seal portion 56 is not limited to the above-described configuration. For example, the outer circumferential surface of the lower shaft portion 19 is formed to be an outer circumferential surface having no concave groove 19A, and the second seal member 57 formed of an elastic band (a rubber band or the like) may be attached.

The working machine 1 according to the embodiment has the following effects.

The working machine 1 includes: the traveling device 3 having the traveling frame 3A; the turn base plate 9 supported on the traveling frame 3A and configured to turn around an axis extending in the vertical direction, the turn base plate 9 having an opening portion (a first opening portion) 9A through which the axis extends; and the swivel joint 12 including: the outer sleeve 13 fixed to the turn base plate 9; and the inner shaft 14 inserted to the opening portion 9A and inserted to the outer sleeve 13 so as to rotate about the axis, the inner shaft 14 being configured to restrictively rotate with respect to the traveling frame 3A. The outer sleeve 13 has the flange portion 17A fixed to the turn base plate 9 on a periphery of the opening portion 9A and covering the opening portion 9A.

According to the configuration, since the outer sleeve 13 of the swivel joint 12 has the flange portion 17A that is fixed to the turn base plate 9 around the opening portion 9A and covers the opening portion 9A, it is possible to prevent the parts and tools from falling from the opening portion 9A provided on the turn base plate 9 and to prevent the fluid from dropping from the opening portion 9A.

In addition, the inner shaft 14 has an outer diameter smaller than an inner diameter of the opening portion 9A. The flange portion 17A is fixed to an upper surface of the turn base plate 9 on the periphery of the opening portion 9A.

According to the configuration, the swivel joint 12 can be removed upward in removing the swivel joint 12 from the turn base plate 9. Thus, the swivel joint 12, which is a heavy object, can be lifted and removed, and thus the upward removing can be performed more easy compared to the downward removing of the swivel joint 12. In addition, when the swivel joint 12 is attached to the turn base plate 9, it can be attached from above the turn base plate 9, so that the attachment can be easily performed. Also, by removing the swivel joint 12 in the upward direction, the fluid does not drip during the removing of the swivel joint 12, and the worker or the like can avoid the dirt.

In addition, the working machine 1 includes the turn restrictor mechanism to restrict rotation of the inner shaft 14 with respect to the traveling frame 3A. The turn restrictor mechanism has: the first flat portion 46 provided on an outer circumferential surface of the inner shaft 14; and the second flat portion 47 provided to the traveling frame 3A, and opposed to the first flat portion 46 and contacted to the first flat portion 46 to restrict the rotation of the inner shaft 14 with respect to the traveling frame 3A.

According to the configuration, the inner shaft 14 can be prevented from rotating with respect to the traveling frame 3A with a simple configuration in which the inner shaft 14 and the traveling frame 3A are provided with the flat portions (the first flat portion 46 and the second flat portion 47). Thus, a special stopper or the like for stopping the inner shaft 14 from rotating with respect to the traveling frame 3A is not required. In addition, since the rotation can be stopped by the contact between the flat portions (the first flat portion 46 and the second flat portion 47), the turn restrictor mechanism can receive a large rotation torque, and thus the turn restrictor mechanism is prevented from being damaged.

In addition, the turn restrictor mechanism has: the third flat portion 48 provided to a position different from a position of the first flat portion in a circumferential direction of the outer circumferential surface of the inner shaft 14; and the fourth flat portion 49 provided to the traveling frame 3A, and opposed to the second flat portion 47 and contacted to the second flat portion 47 to restrict the rotation of the inner shaft 14 with respect to the traveling frame 3A.

According to the configuration, in addition to the contact between the first flat portion 46 and the second flat portion 47, the contact between the third flat portion 48 and the fourth flat portion 49 can also restrict the rotation of the inner shaft 14 with respect to the traveling frame 3A. Thus, the inner shaft 14 can be reliably prevented from rotating with respect to the traveling frame 3A.

In addition, the outer sleeve 13 has the first seal portion 44 provided on the surface opposed to the turn base plate 9, the first seal portion 44 sealing between the outer sleeve 13 and the turn base plate 9.

According to the configuration, the gap between the outer sleeve 13 and the turn base plate 9 can be sealed by the first seal portion 44, so that the fluid, dust, and the like can be prevented from falling from the gap to the traveling frame 3A through the opening portion 9A.

In addition, the outer sleeve 13 has the inserting portion 17B inserted to the opening portion 9A. The first seal portion 44 is provided on the outer circumferential surface of the inserting portion and seals between the outer circumferential surface and the inner circumferential surface of the opening portion 9A.

According to the configuration, the gap between the outer circumferential surface of the insertion portion 17B and the inner circumferential surface of the first opening portion 9A is sealed by the first seal portion 44, so that the fluid, dust, and the like can be prevented from falling from the gap to the traveling frame 3A. In addition, by providing the first seal portion 44 on the outer circumferential surface of the insertion portion 17B, the outer diameter of the swivel joint 12 can be made smaller compared to a diameter provided when the seal portion is provided on the lower surface of the flange portion 17A or the like. In this manner, the turn motor M3 can be arranged close to the swivel joint 12 while preventing the turn motor M3 and the swivel joint 12 from interfering with each other.

In addition, the working machine 1 includes the grease bath 50 provided between the turn base plate 9 and the traveling frame 3A. The outer circumferential surface of the inner shaft 14 has the second seal portion 56 sealing between the outer circumferential surface and the inner circumferential surface of the grease bath 50.

According to the configuration, since the gap between the outer circumferential surface of the lower shaft portion 19 and the inner circumferential surface of the grease bath 50 is sealed by the second seal portion 56, it is possible to prevent the grease or fluid from leaking out from the gap. In addition, since the lower shaft portion 19 of the inner shaft 14 is prevented from rotating by the turn restrictor mechanism, the second seal portion 56 does not slide with respect to the grease bath 50. In this manner, the excellent sealing performance can be ensured, and the durability of the second seal portion 56 can be improved.

In the above description, the embodiment of the present invention has been explained. However, all the features of the embodiment disclosed in this application should be considered just as examples, and the embodiment does not restrict the present invention accordingly. A scope of the present invention is shown not in the above-described embodiment but in claims, and is intended to include all modifications within and equivalent to a scope of the claims.

What is claimed is:

1. A working machine comprising:

a traveling device having a traveling frame;

a turn base plate supported on the traveling frame and configured to turn around an axis extending in a vertical direction, the turn base plate having an opening portion through which the axis extends; and a swivel joint including:

an outer sleeve fixed to the turn base plate; and an inner shaft inserted to the opening portion and inserted to the outer sleeve so as to rotate about the axis, the inner shaft being configured to restrictively rotate with respect to the traveling frame, wherein the outer sleeve has a sleeve body, a lower member fixed to a lower portion of the sleeve body, and an upper member fixed to an upper portion of the sleeve body, wherein the lower member is independent of the sleeve body and is fixed to the lower portion of the sleeve body by at least one bolt, wherein the upper member is independent of the sleeve body and is fixed to the upper portion of the sleeve body by at least one bolt, wherein the lower member has a flange portion fixed to an upper surface of the turn base plate on a periphery of the opening portion and covering the opening portion, and an insertion portion formed integrally with the flange portion and inserted into the opening portion, wherein the outer sleeve has, in an outer circumferential surface thereof, first connection ports to which pipes are connected, wherein the inner shaft has, in a lower surface thereof, second connection ports communicating with the first connection ports, and wherein the flange portion has an outer diameter larger than an inner diameter of the opening portion.

2. The working machine a.ccording to claim 1, wherein the inner shaft has an outer diameter smaller than the inner diameter of the opening portion.

3. The working machine according to claim 1, comprising a turn restrictor mechanism to restrict rotation of the inner shaft with respect to the traveling frame, wherein the turn restrictor mechanism has:

a first fiat portion provided on an outer circumferential surface of the inner shaft; and a second flat portion provided to the traveling frame, and opposed to the first flat portion and contacted to the first flat portion to restrict the rotation of the inner shaft with respect to the traveling frame.

4. The working machine according to claim 3, wherein the turn restrictor mechanism has:

a third flat portion provided to a position different from a position of the first flat portion in a circumferential direction of the outer circumferential surface of the inner shaft; and a fourth flat portion provided to the traveling frame, and opposed to the third flat portion and contacted to the third flat portion to restrict the rotation of the inner shaft with respect to the traveling frame.

5. The working machine according to claim 1, wherein the outer sleeve has a first seal portion provided on a surface opposed to the turn base plate, the first seal portion sealing between the outer sleeve and the turn base plate.

6. The working machine according to claim 5, wherein the first seal portion is provided on an outer circumferential surface of the insertion portion and seals between the outer circumferential surface and an inner circumferential surface of the opening portion.

7. The working machine according to claim 1, further comprising:

a grease bath provided between the turn base plate and the traveling frame, wherein the outer circumferential surface of the inner shaft has a second seal portion sealing between the outer circumferential surface and an inner circumferential surface of the grease bath.

8. The working machine according to claim 1, wherein the sleeve body has an upper tubular portion arranged above the lower member and a lower tubular portion arranged radially inside the lower member; and the lower tubular portion has a lower portion arranged in the opening portion and radi ally inside the insertion portion.

9. The working machine according to claim 8, wherein the lower tubular portion includes a lower end positioned lower than the flange portion; and the lower tubular portion includes an upper end positioned higher than the insertion portion.

10. The working machine according to claim 1, wherein the lower member includes:

a center hole in which an upper portion of the inner shaft is inserted; and a plurality of through holes located radially outside the center hole;

the lower member includes spot face portions located at lower portions of the plurality of through holes; and heads of a plurality of the bolts, which fix the lower member and the sleeve body, are located in the respective spot face portions and thus do not protrude from a lower surface of the lower member.

11. The working machine according to claim 1, wherein the sleeve body has an internal hole;

the inner shaft has:

an upper shaft portion inserted in the internal hole; and a lower shaft portion arranged below the turn base plate; and a head of the at least one bolt, which fixes the lower member and the sleeve body, is located between the lower shaft portion and the lower member in the vertical direction.

* * * * *